US010234787B2

(12) United States Patent
Watanabe

(10) Patent No.: US 10,234,787 B2
(45) Date of Patent: Mar. 19, 2019

(54) IMAGE FORMING APPARATUS HAVING A CONTROLLER THAT CONTROLS A FIXING CONDITION IN RESPONSE TO A SELECTED LEVEL OF CREASE OR FINISH OF AN ENVELOPE

(71) Applicant: CANON KABUSHIKI KAISHA, Tokyo (JP)

(72) Inventor: Tatsuhito Watanabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/647,698

(22) Filed: Jul. 12, 2017

(65) Prior Publication Data

US 2018/0017911 A1 Jan. 18, 2018

(30) Foreign Application Priority Data

Jul. 13, 2016 (JP) ..... 2016-138421

(51) Int. Cl.
*G03G 15/08* (2006.01)
*G03G 15/20* (2006.01)
*G03G 15/00* (2006.01)

(52) U.S. Cl.
CPC ..... *G03G 15/0856* (2013.01); *G03G 15/0858* (2013.01); *G03G 15/206* (2013.01); *G03G 15/2042* (2013.01); *G03G 15/2046* (2013.01); *G03G 15/6591* (2013.01); *G03G 15/086* (2013.01); *G03G 15/2028* (2013.01); *G03G 15/2064* (2013.01); *G03G 2215/2045* (2013.01)

(58) Field of Classification Search
CPC ..... G03G 15/2082; G03G 15/2089; G03G 15/2028; G03G 2215/00514; G03G 15/2032; G03G 15/2067
See application file for complete search history.

(56) References Cited

U.S. PATENT DOCUMENTS

| | | | | |
|---|---|---|---|---|
| 7,113,716 | B2 | 9/2006 | Tomatsu | |
| 2004/0240913 | A1* | 12/2004 | Tomatsu | G03G 15/2064 399/328 |
| 2014/0029968 | A1* | 1/2014 | Tamaki | G03G 15/2064 399/67 |
| 2016/0378031 | A1* | 12/2016 | Takahashi | G03G 15/2053 399/67 |

FOREIGN PATENT DOCUMENTS

JP 2004-279702 A 10/2004

* cited by examiner

*Primary Examiner* — Sandra Brase
(74) *Attorney, Agent, or Firm* — Venable LLP

(57) ABSTRACT

An image forming apparatus includes an image forming station configured to form a toner image on a recording material, a fixing portion configured to fix the toner image formed by the image forming station on the recording material, a selector configured to select a correction level for correcting a crease of an envelope, by an operator, and a controller configured to control a fixing condition in response to the correction level selected on the selector.

7 Claims, 19 Drawing Sheets

IMAGE FORMING APPARATUS HAVING A CONTROLLER THAT CONTROLS A FIXING CONDITION IN RESPONSE TO A SELECTED LEVEL OF CREASE OR FINISH OF AN ENVELOPE

This application claims the benefit of Japanese Patent Application No. 2016-138421 filed on Jul. 13, 2016, which is hereby incorporated by reference herein in its entirety.

FIELD OF THE INVENTION AND RELATED ART

The present invention relates to an image forming apparatus that forms a toner image on a sheet of recording medium. As examples of this type of image forming apparatus, an electrophotographic copying machine, an electrophotographic printing machine, an electrophotographic facsimile machine, and an electrophotographic multifunction machine that is capable of functioning as two or more of the preceding machines, can be listed.

An electrophotographic copying machine is equipped with a fixing apparatus that uses a combination of heat and pressure to fix a toner image transferred onto a sheet of recording medium (also referred to as recording paper or simply paper), to the sheet.

In the market related to image formation, it has been desired to satisfactorily form an image on an envelope as recording medium. In order to meet this desire, various attempts have been made. In the case of the image forming apparatus disclosed in Japanese Laid-open Patent Application No. 2004-279702, in order to prevent an envelope from creasing during a fixing process, an envelope mode and a normal mode are made different in a fixation condition. More concretely, the envelope mode is made less in fixation pressure than the normal mode.

By the way, in recent years, an envelope has substantially increased in choices in terms of size and material. Thus, it has become difficult to fix a toner image on an envelope at a satisfactory level while preventing the envelope from creasing, with the use of a fixing apparatus that cannot be changed in the fixation condition. For example, there is a concern that even if a toner image on an envelope of a certain type can be satisfactorily fixed under a specific condition that can yield an image of high quality, this fixation condition may not be satisfactory from the standpoint of preventing an envelope from creasing.

It is possible to provide a fixing apparatus with as many fixation settings as the number of envelope types, so that the fixing apparatus can be properly set for each type of envelope. This solution, however, is unrealistic.

Thus, there have been substantial demands for an image forming apparatus that enables a user to easily form a satisfactory image even on an envelope of the newest type.

SUMMARY OF THE INVENTION

According to one aspect, the present invention provides an image forming apparatus comprising an image forming station configured to form a toner image on a recording material, a fixing portion configured to fix the toner image formed by the image forming station on the recording material, a selector configured to select a correction level for correcting crease of an envelope, by an operator, and a controller configured to control a fixing condition in response to the correction level selected on the selector.

Further features of the present invention will become apparent from the following description of exemplary embodiments with reference to the attached drawings.

Figure 8:
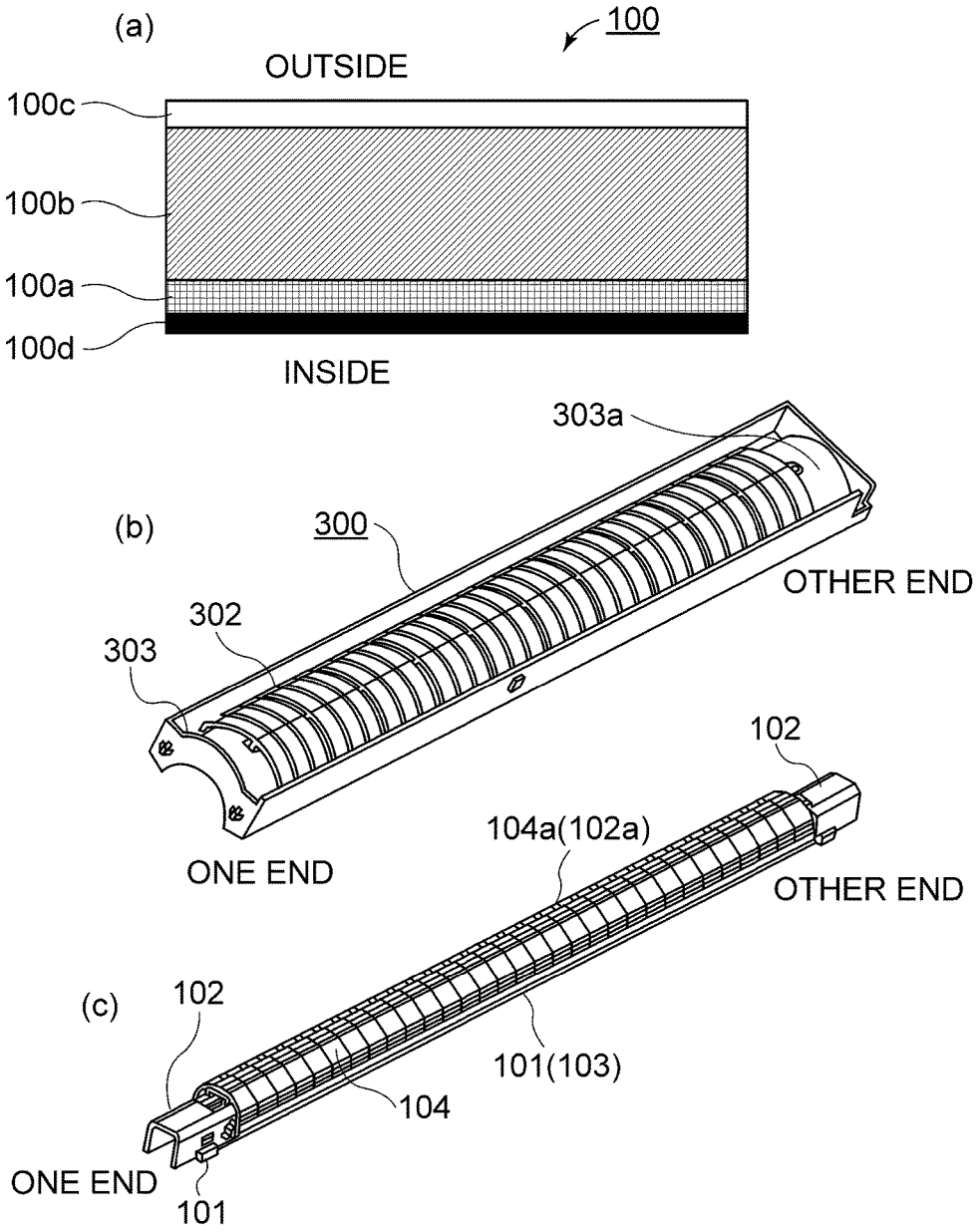

Part (a) of FIG. 8 is a schematic sectional view of the fixation belt, and is for describing the laminar structure of the belt. Part (b) of FIG. 8 is a perspective view of the coil unit after the removal of its cover plate. Part (c) of FIG. 8 is a perspective view of the internal assembly of the belt unit.

Figure 9:
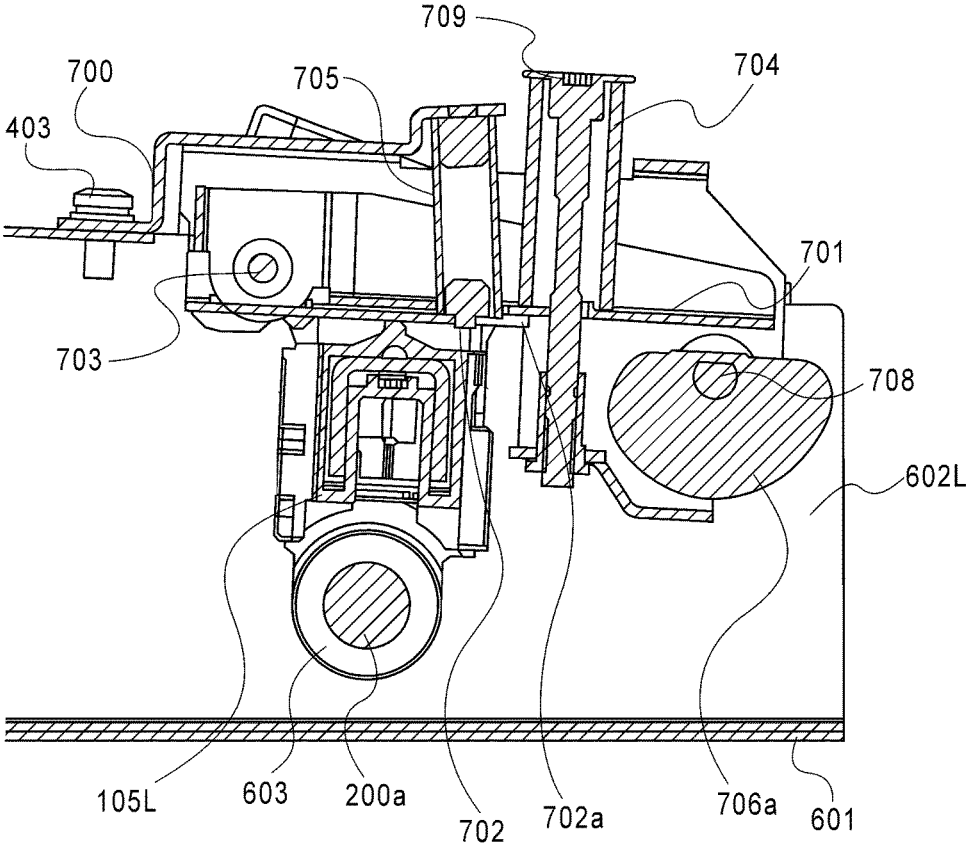

FIG. 9 is a sectional view (at plane A-A in FIG. 4) of the pressure changing mechanism when the fixing apparatus is in the normal pressure mode.

Figure 10:
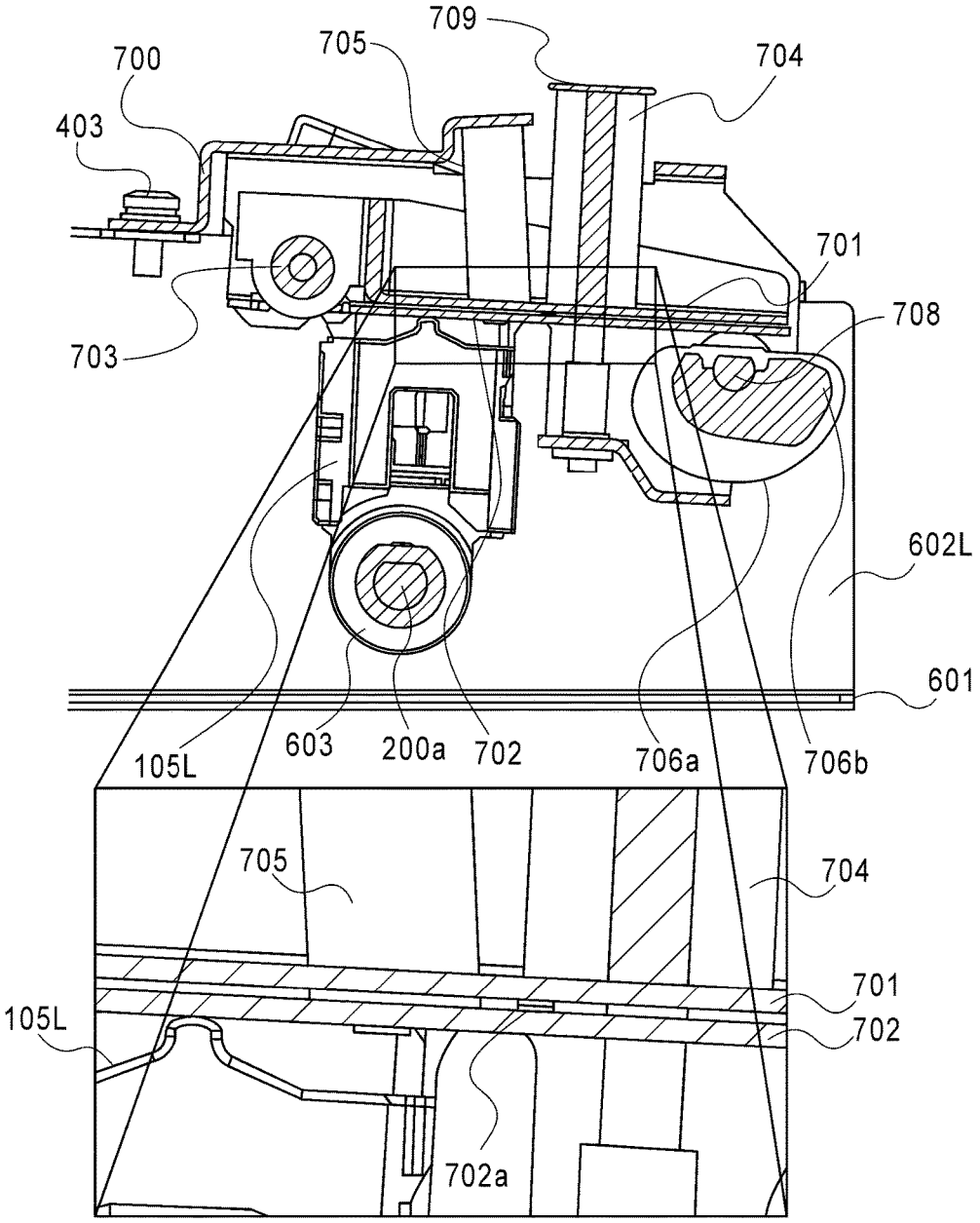

FIG. 10 is a sectional view (at plane B-B in FIG. 4) of the nip pressure changing mechanism when the fixing apparatus is in the normal pressure mode.

Figure 11:
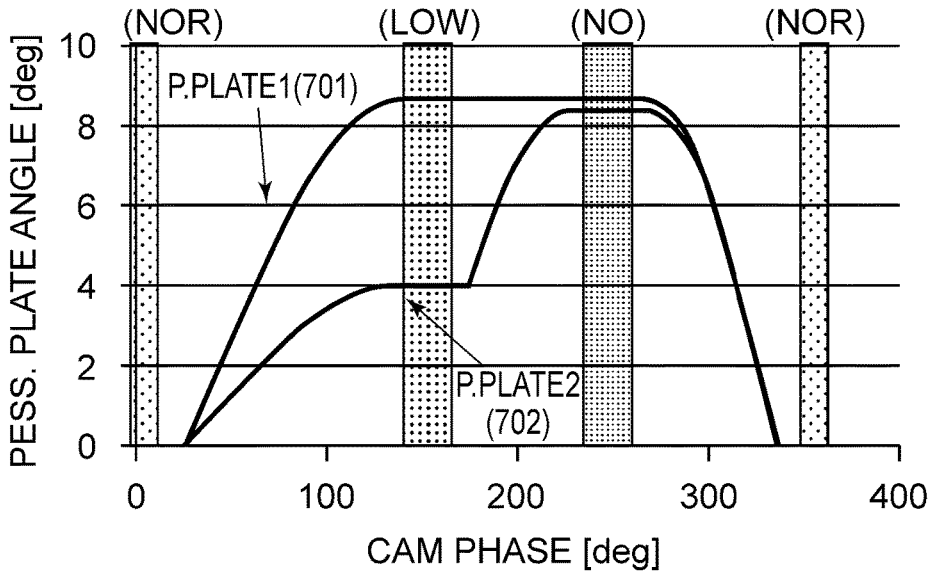

FIG. 11 is a graph that shows the relationship among a pressure plate angle, a cam angle, and a nip pressure.

Figure 12:
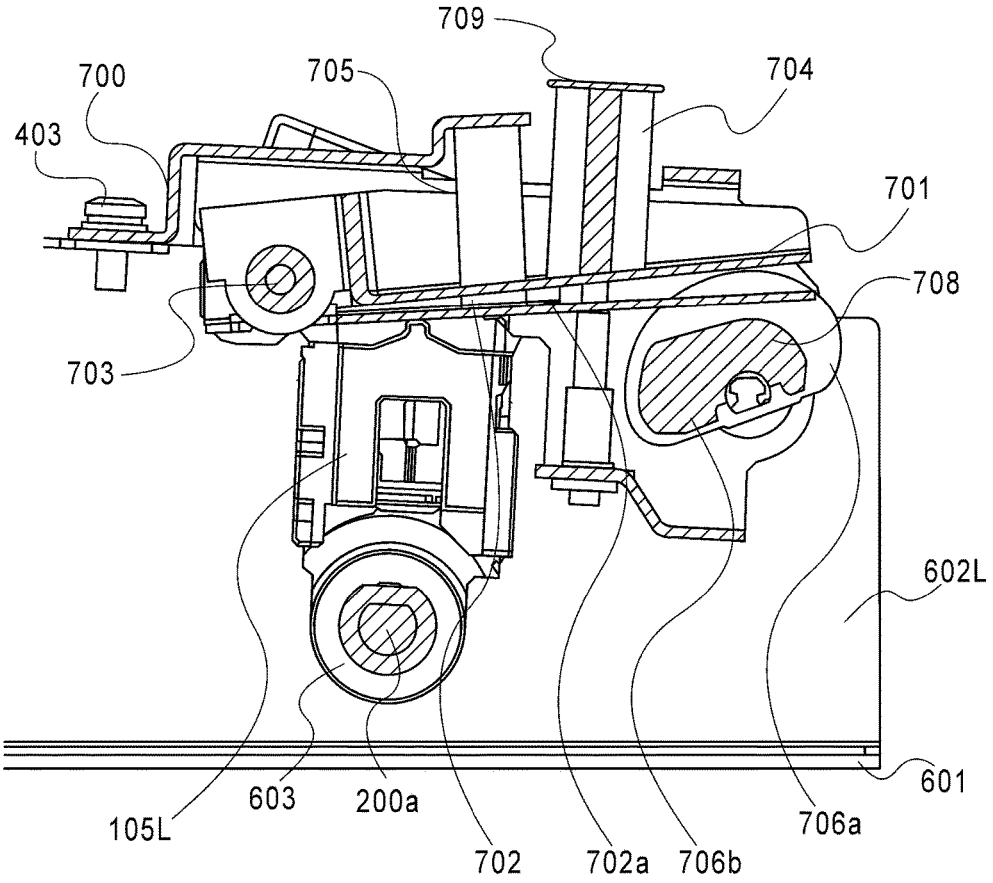

FIG. 12 is a sectional view (at plane B-B in FIG. 4) of the nip pressure changing mechanism when the fixing apparatus is in the low pressure mode.

Figure 13:
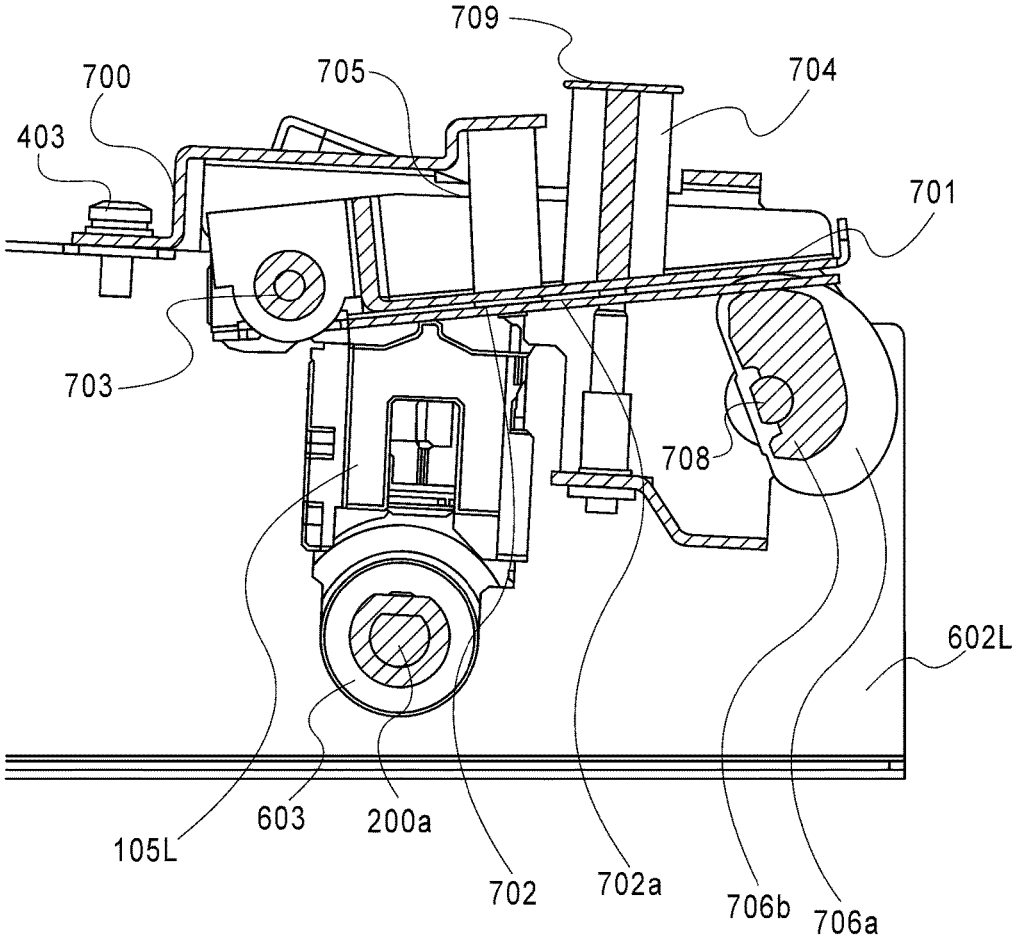

FIG. 13 is a sectional view (at plane B-B in FIG. 4) of the nip pressure changing mechanism when the fixing apparatus is in the no pressure mode.

Figure 14:
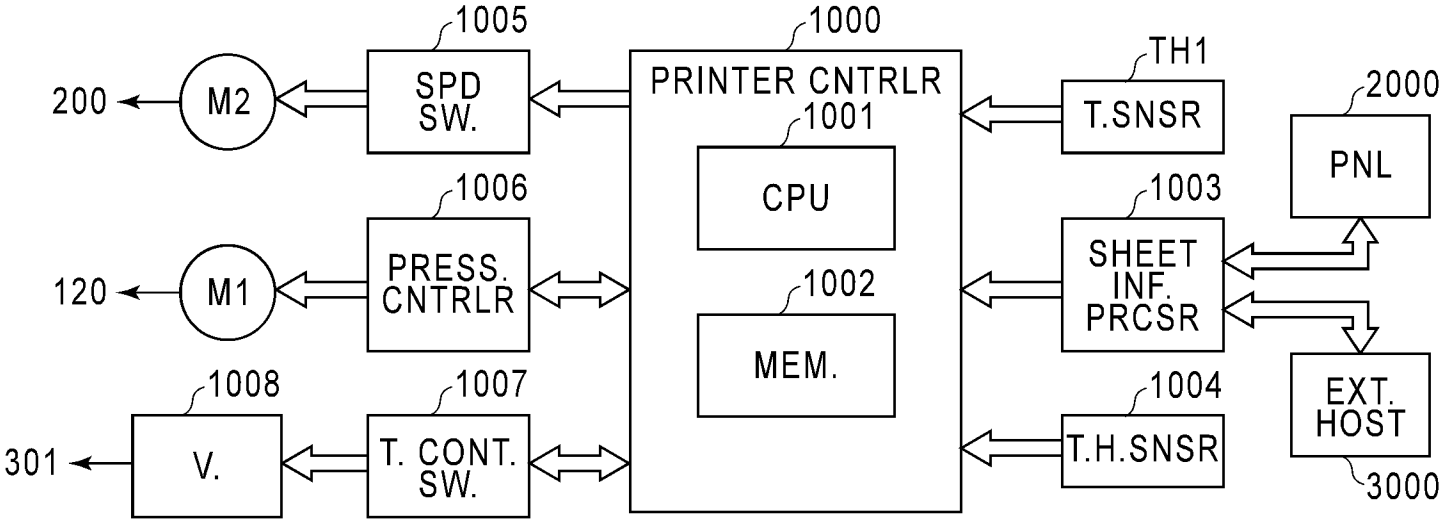

FIG. 14 is a block diagram of the control system.

Figure 15:
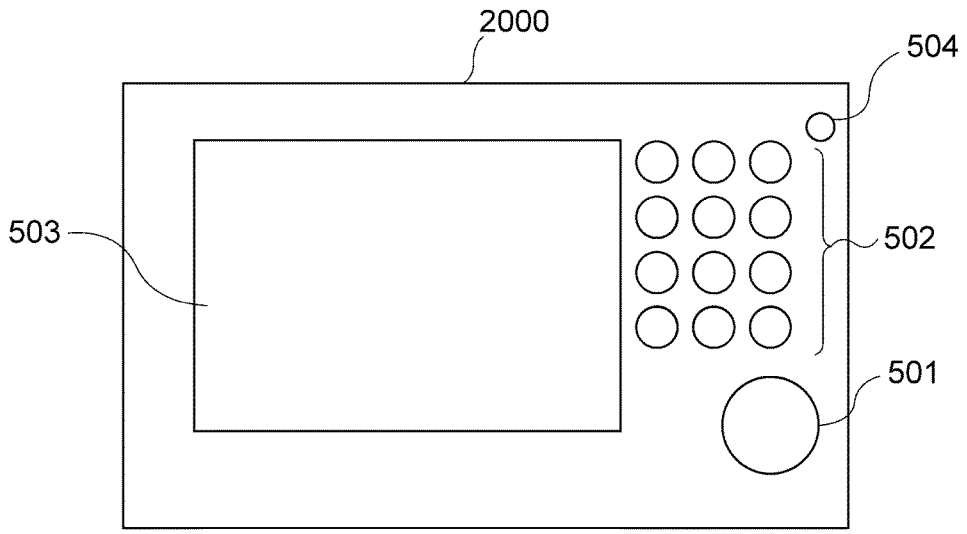

FIG. 15 is a schematic drawing of the control panel of the image forming apparatus.

Figure 16:
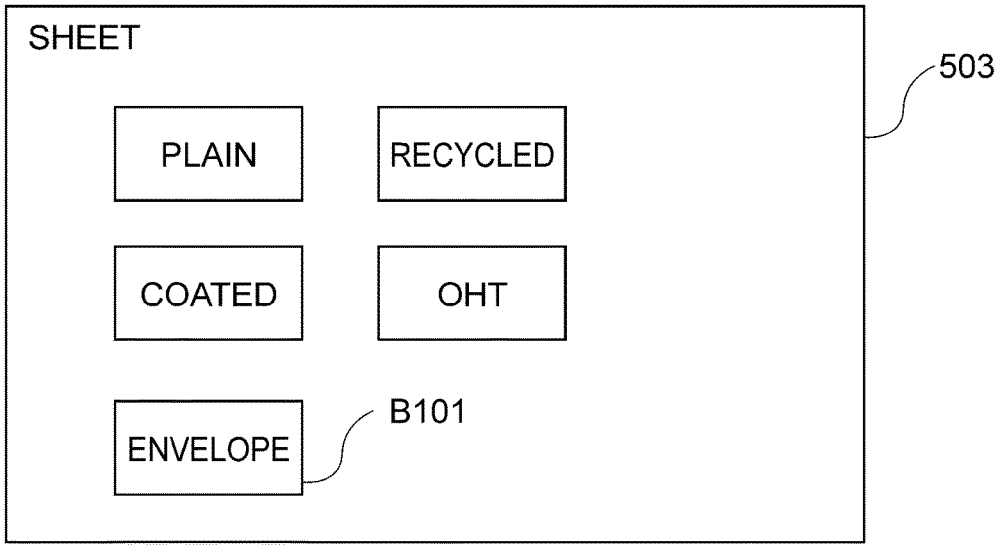

FIG. 16 is a schematic drawing of the display screen of the control panel.

Figure 17:
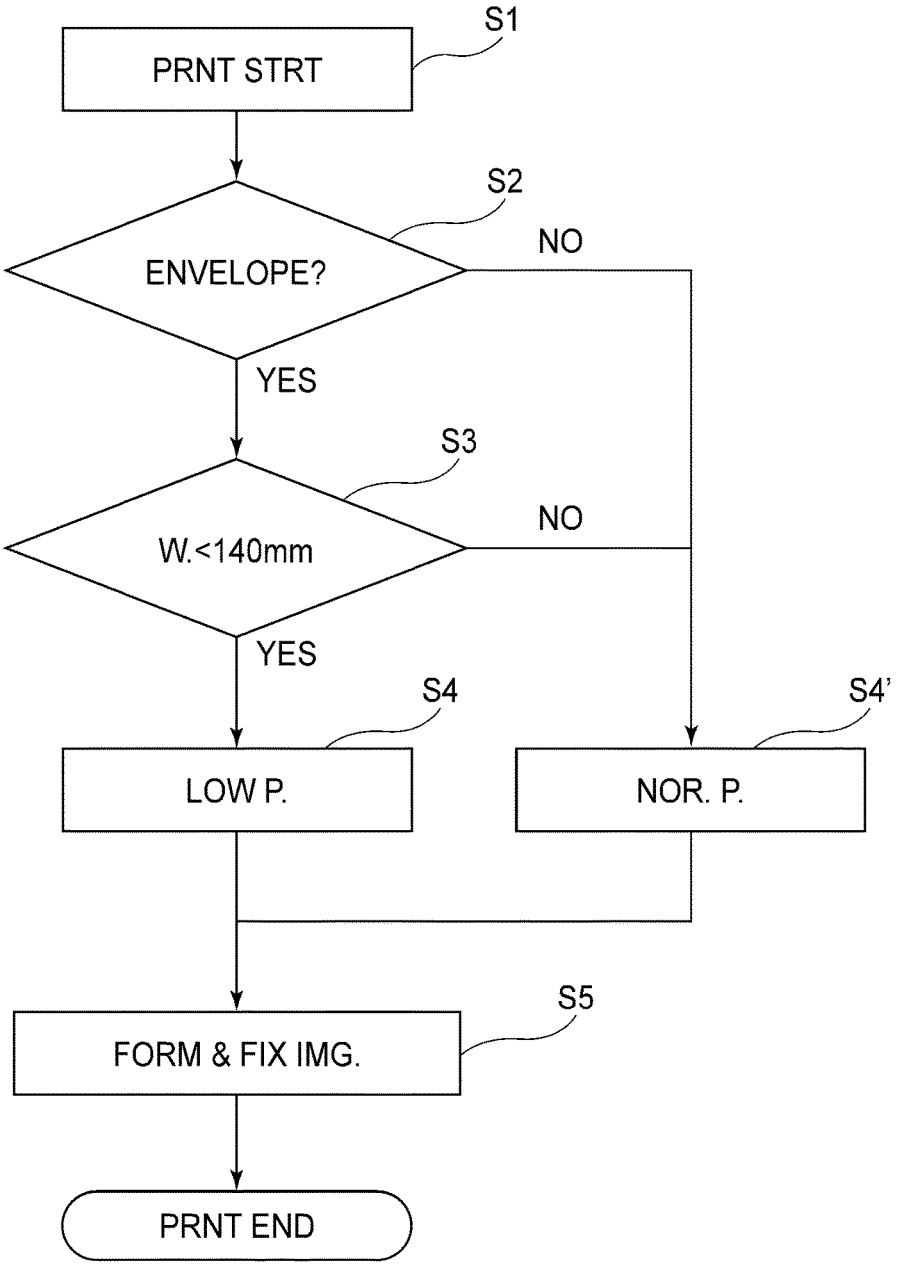

FIG. 17 is a flowchart of the control sequence (1).

Figure 18:
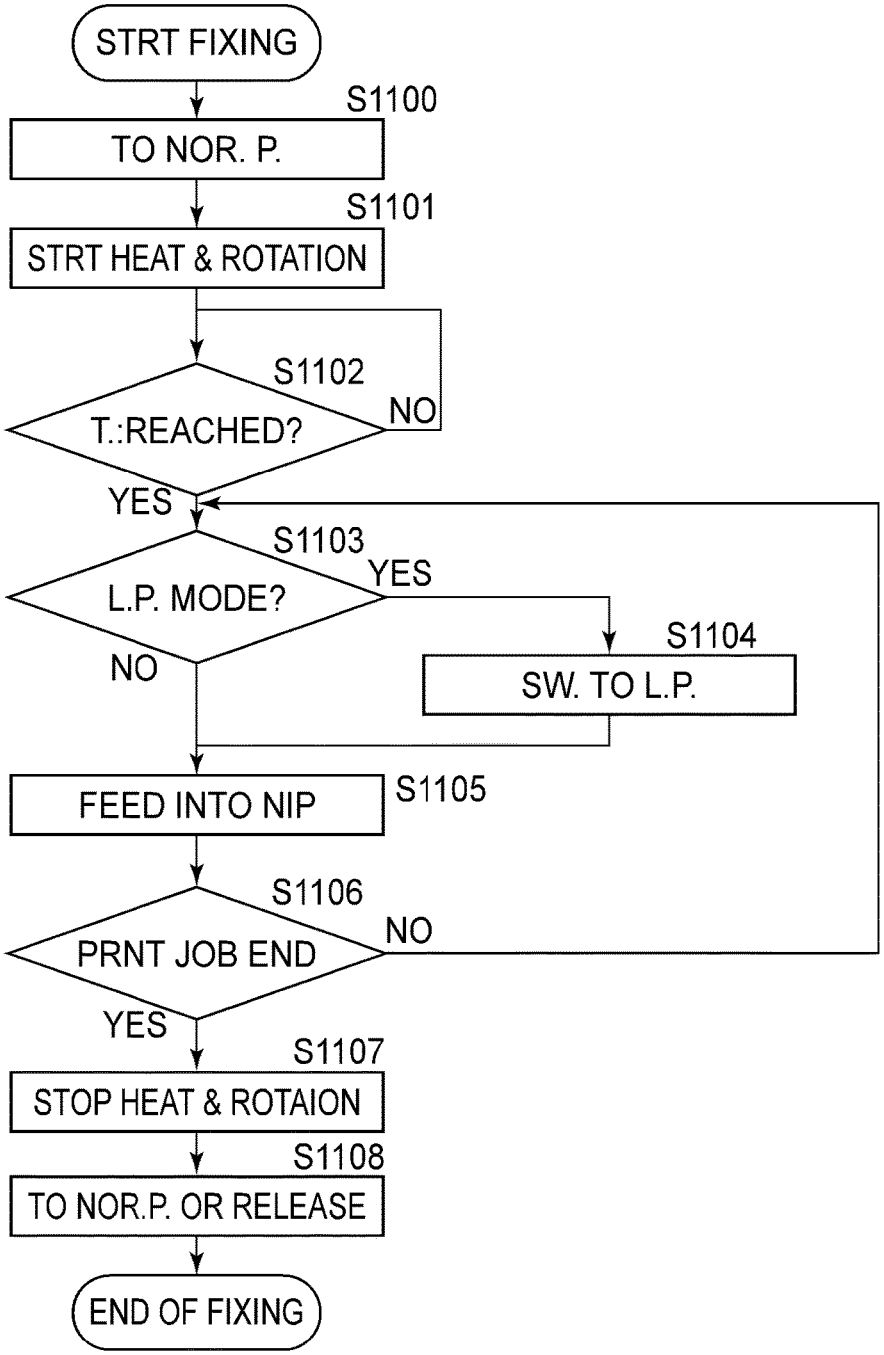

FIG. 18 is a flowchart of the control sequence (2).

Figure 19:
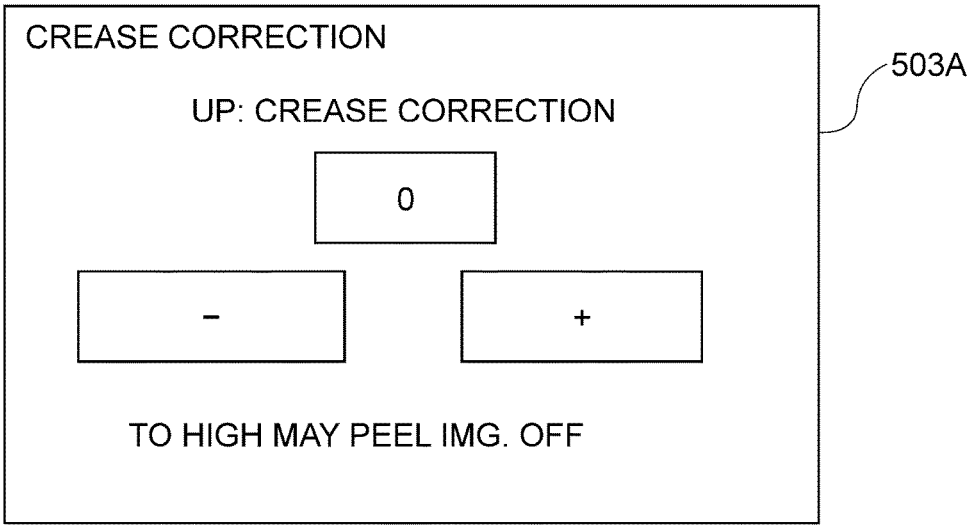

FIG. 19 is a drawing of the crease prevention screen.

DESCRIPTION OF THE EMBODIMENTS

The present invention is described with reference to one of the preferred embodiments of the present invention. By the way, the following embodiments are examples of preferred embodiments of the present invention, but are not intended to limit the present invention in scope

Embodiment 1

[Image Forming Apparatus]

Figure 2:
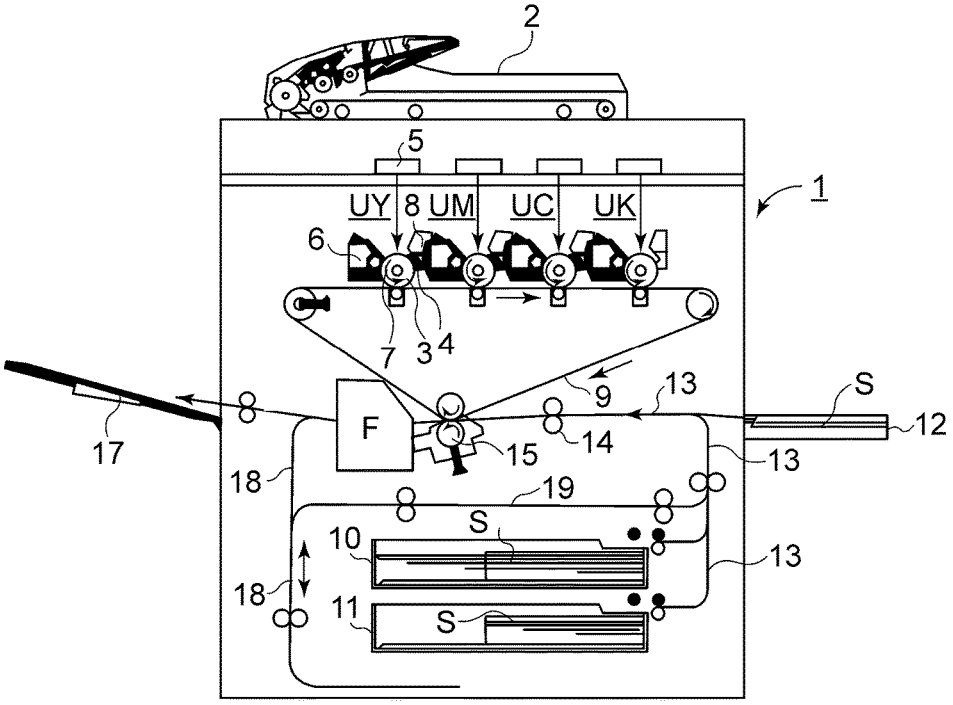
FIG. 2 is a schematic sectional view of a typical image forming apparatus to which the present invention is applicable, and shows the structure of the image forming apparatus.

FIG. 2 is a schematic sectional view of the image forming apparatus 1 in the first embodiment, and shows the structure of the image forming apparatus 1. This image forming apparatus 1 is equipped with an automatic original feeding apparatus 2. It is an electrophotographic full-color image copying machine of the so-called tandem type, and also, of the so-called intermediary transfer type.

The apparatus main assembly has four image forming portions UY, UM, UC, and UBk, that form yellow (Y), magenta (M), cyan (C), and black (Bk) toner images, respectively. Each image forming portion has a photosensitive drum 3, a charging device 4, a laser scanner 5, a developing device 6, a primary transfer roller 7, and a drum cleaner 8. By the way, in order to prevent the image forming apparatus 1 from appearing excessively complicated, the referential codes for the image forming portions UM, UC, and UBk, that is, the image forming portions other than the image forming portion UY, are only shown in FIG. 2. Further, the electrophotographic process and the other image formation steps of these image forming portions are widely known, and, therefore, they are not described.

Four toner images, different in color, are sequentially transferred onto a rotationally moving intermediary transfer belt 9, from the photosensitive drums 3, in such a manner that they are layered on the intermediary transfer belt 9 (primary transfer). Consequently, the four toner images, different in color, are layered on the intermediary transfer belt 9. Meanwhile, sheets S of recording medium (also referred to simply as recording paper, or paper) are fed one by one from a cassette 10 or 11, or a manual feeding tray 12, into the apparatus main assembly. Then, each sheet S of recording paper is conveyed through a recording medium conveyance passage 13, and is then introduced, by a pair of registration rollers 14, into the secondary transfer nip, which is an area in which the intermediary transfer belt 9 and a secondary transfer roller 15 are kept pressed upon each other, with preset control timing. While the sheet S is conveyed through the secondary transfer nip, the layered four toner images on the intermediary transfer belt 9, different in color, are transferred together onto the sheet S (secondary transfer).

In the image forming apparatus 1 in this embodiment, the portions described above constitute a portion for forming an unfixed toner image on a sheet S of recording paper. Then, the sheet S of recording paper is introduced into a fixing apparatus F (fixing portion), as an image heating apparatus, and is conveyed through the fixing apparatus F, while being heated and pressed. Thus, the unfixed toner images become melted/softened, and become fixed to the sheet S (thermal fixation: image heating process). In a case in which an image formation job is to be carried out in the one-sided mode, the sheet S is discharged onto a delivery tray 17 after the unfixed toner images on the first surface of the sheet S are fixed, and the sheet S comes out of the fixing apparatus F.

On the other hand, in a case in which the image forming job is to be carried out in the two-side mode, the sheet S having a fixed image on one of its two surfaces is conveyed through a sheet turning conveyance passage 19 to be turned over, and is then introduced into the secondary transfer nip, for the second time, through a conveyance passage 13, after it is conveyed through the fixing apparatus F for the first time. Consequently, a second set of toner images is transferred onto the second surface of the sheet S. Then, the sheet S is conveyed through the fixing apparatus F for the second time. Then, the sheet S having a fixed image on both surfaces is discharged onto the delivery tray 17. By the way, the image forming apparatus 1 in this embodiment is structured so that, when a sheet S of recording paper is conveyed through the image forming apparatus 1, its center in terms of its widthwise direction coincides with the center of the recording medium passage of the apparatus main assembly, regardless of its size. The present invention is also applicable, however, to an image forming apparatus structured so that, when a sheet S of recording paper is conveyed through the image forming apparatus, one of the edges of the sheet S remains in contact with the corresponding edge of the recording medium passage of the apparatus.

The image forming apparatus 1, as an electrophotographic image forming apparatus, forms a toner image on a recording medium (i.e., the sheet S) through each of charging, exposing, developing, transferring and fixing processes. By the way, the image forming apparatus 1 may be a black-and-white image forming apparatus having only a black image forming portion. This embodiment is not intended to limit the present invention in terms of the order in which the Y, M, C, and Bk image forming portions arranged, nor in terms of their structure.

[Fixing Apparatus]

Regarding the positioning (attitude) of the fixing apparatus F, described next, the front side of the fixing apparatus F is the side from which a sheet S of recording paper enters the fixing apparatus F. The rear side of the fixing apparatus F is the side from which a sheet S of recording paper is discharged. The left and right sides of the fixing apparatus F are the left and right sides of the fixing apparatus F when the fixing apparatus F is observed from the front side of the fixing apparatus F. Further, in this embodiment, the left and right sides of the fixing apparatus F are referred to as one side (driving side) and the other side (non-drive side), respectively. The top and bottom mean top and bottom with reference to the gravity direction. The upstream and downstream sides mean the upstream and downstream with reference to the direction in which a sheet S of recording paper is conveyed through the fixing apparatus F (recording medium conveyance direction).

Figure 3:
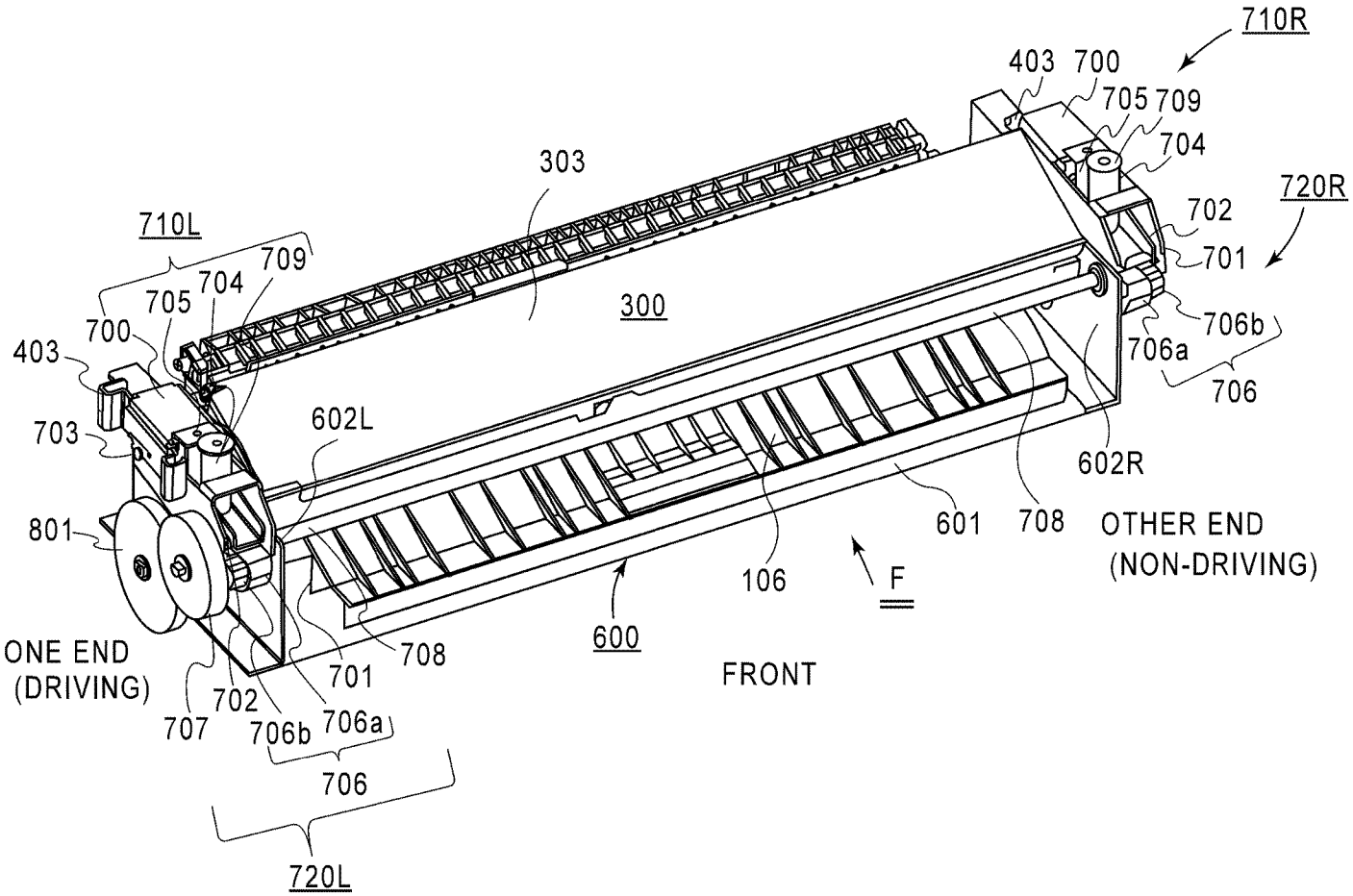
FIG. 3 is a perspective view of the fixing apparatus in the first embodiment, as seen from the front side of the apparatus.
Figure 4:
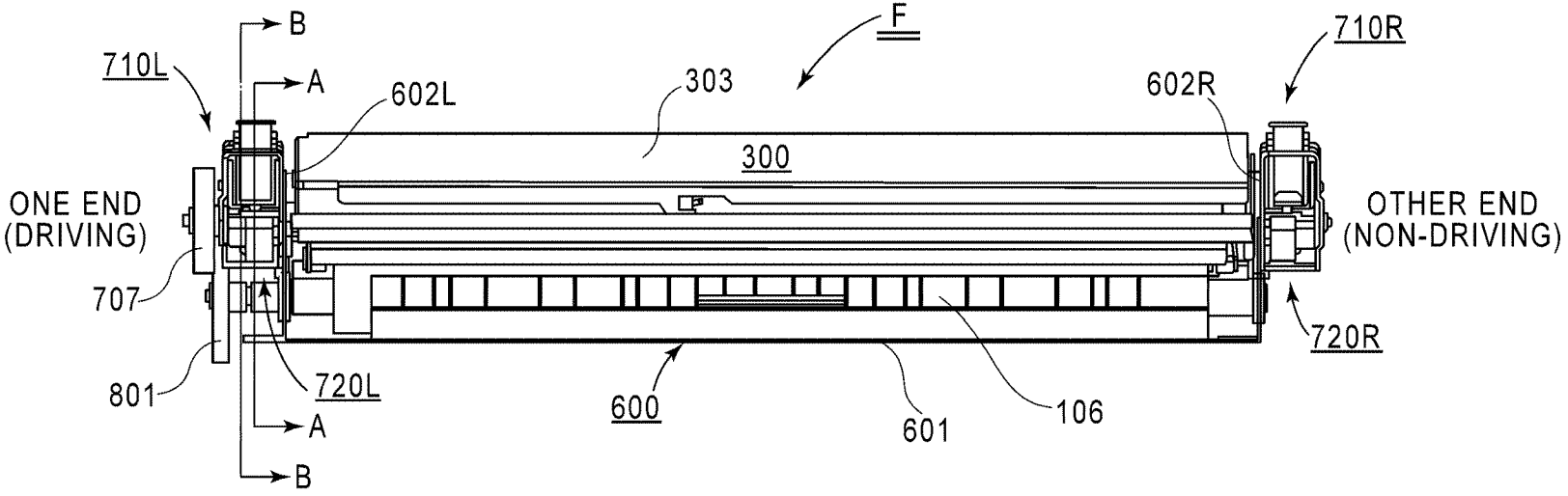
FIG. 4 is a front view of the fixing apparatus in the first embodiment.
Figure 5:
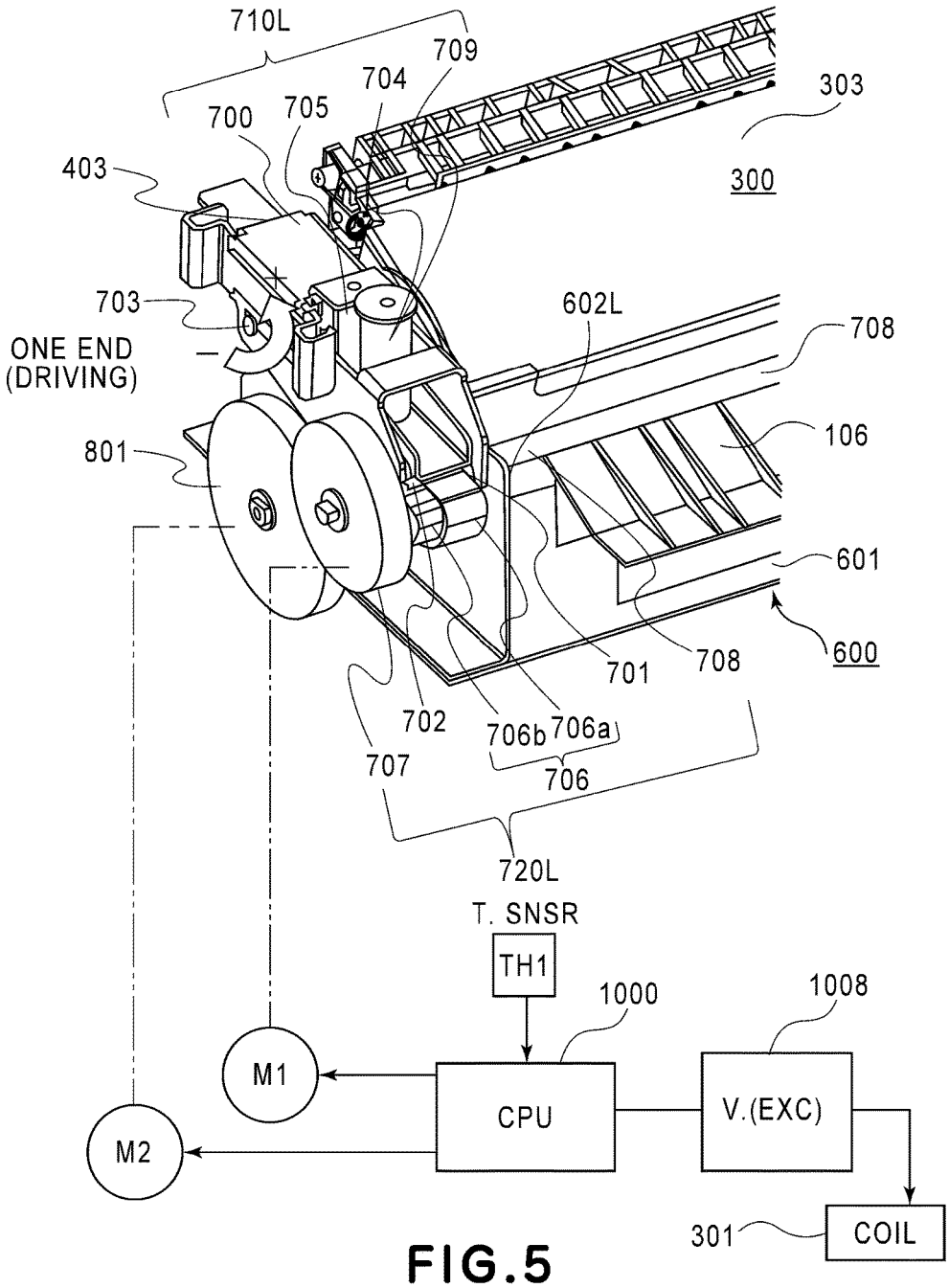
FIG. 5 is a block diagram of a control system in combination with an enlarged perspective view of the driving end portion of the fixing apparatus, in the first embodiment.
Figure 6:
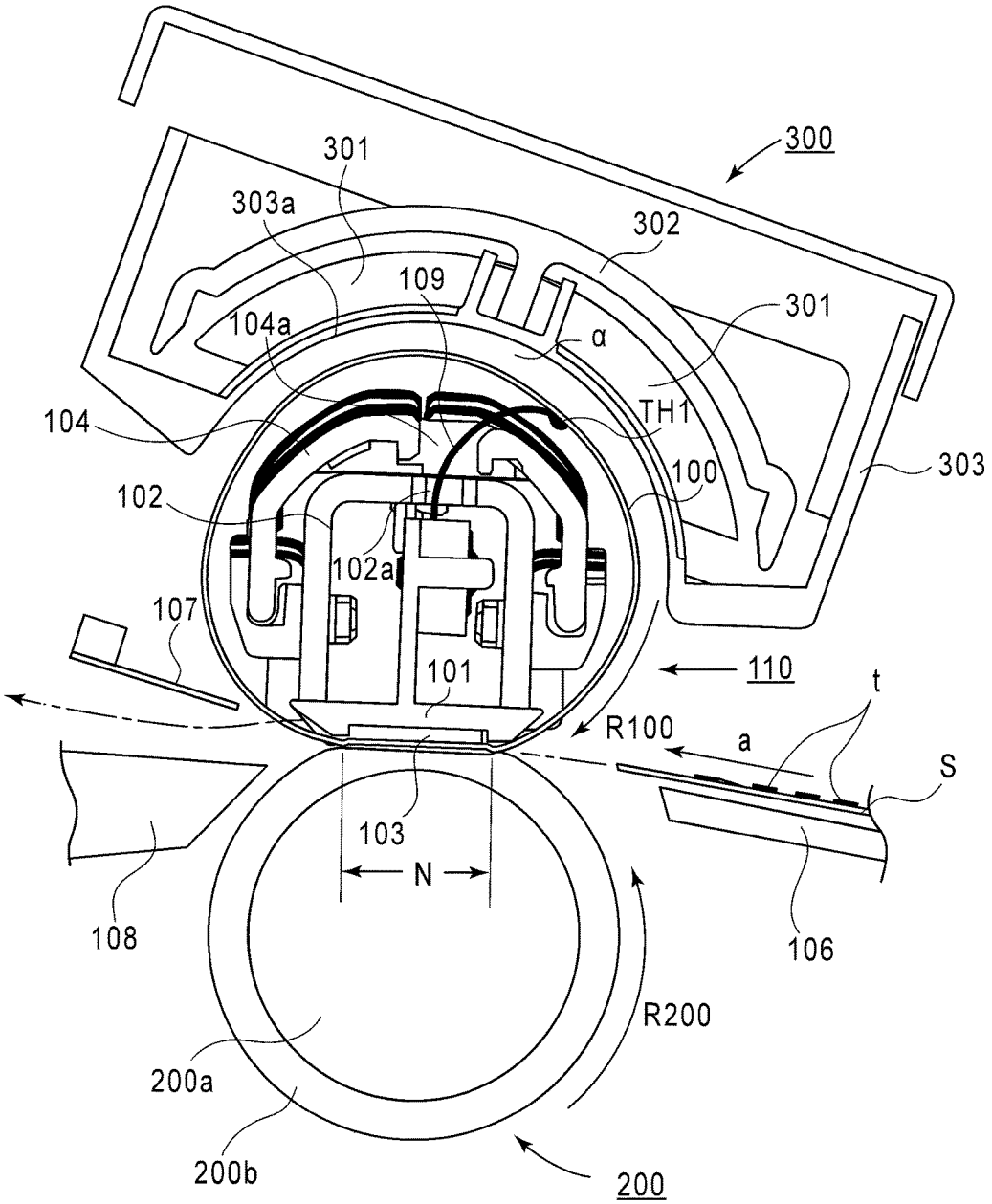
FIG. 6 is a schematic cross-sectional view of the essential portion of the fixing apparatus in the first embodiment.
Figure 7:
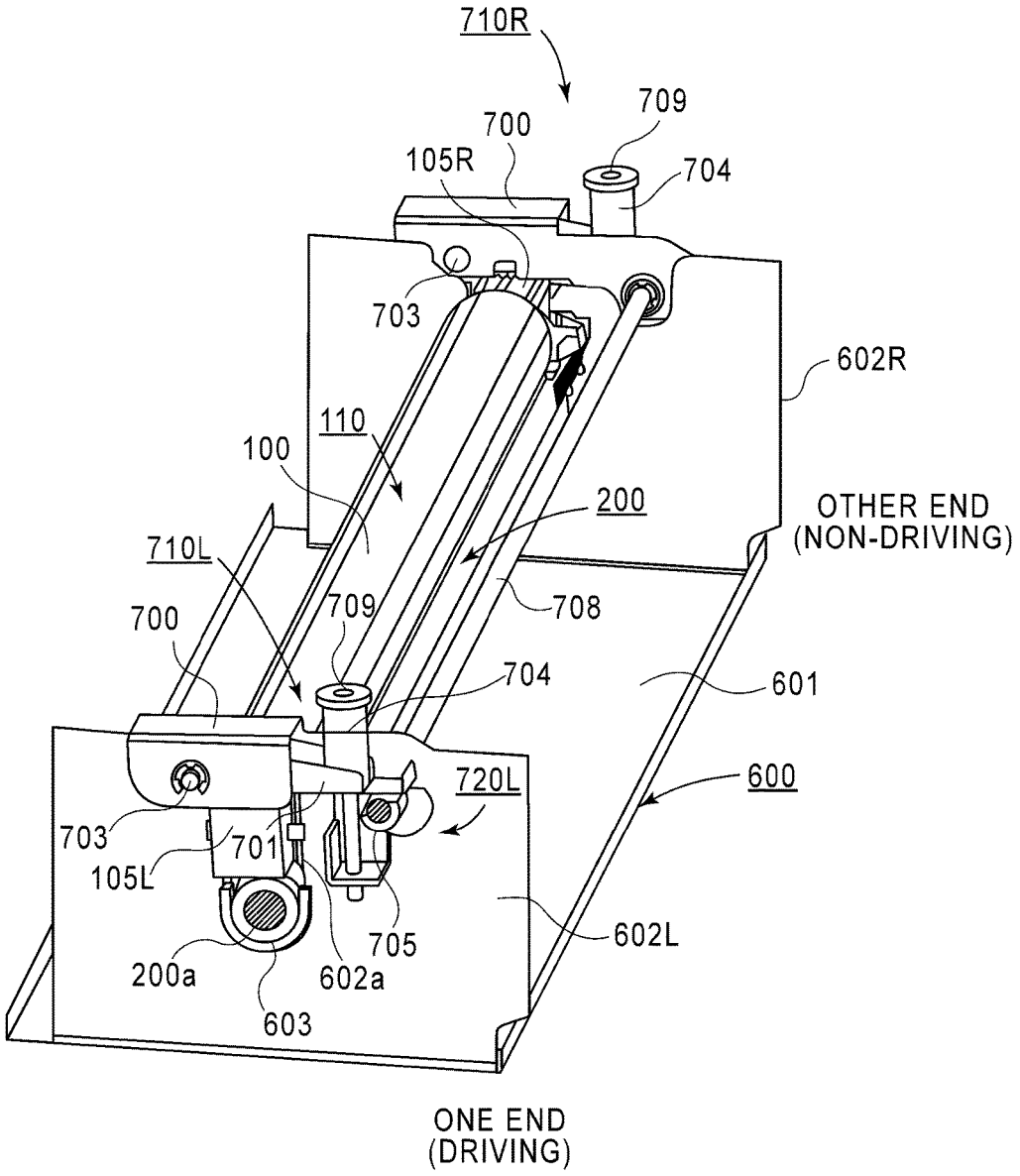
FIG. 7 is a schematic perspective view of the fixing apparatus in the first embodiment, as seen from the driving side, and shows the internal structure of the fixing apparatus.

FIG. 3 is a perspective view of the fixing apparatus F as seen from the front side. FIG. 4 is a front view of the fixing apparatus F. FIG. 5 is a combination of an enlarged perspective view of the driving side of the fixing apparatus F, and a block diagram of the control system. FIG. 6 is an enlarged schematic cross-sectional view of the essential portion of the fixing apparatus F. FIG. 7 is a schematic perspective view of the essential portion of the internal structure of the fixing apparatus F.

The fixing apparatus F in this embodiment is an image heating apparatus of the so-called induction heating (IH) type, and also, of the so-called belt type. Referring to mainly FIG. 6, the fixing apparatus F has the following members and mechanisms.

(A) A belt unit 110 having a flexible endless belt 100 (also referred to as a fixation belt or simply as a belt) as a first rotational member (rotational heating member, or fixing member) that heats a toner image t, formed on a sheet S of recording paper, in a nip N.

(B) An elastic pressure roller 200 as a second rotational member (rotational pressing member) that forms the nip N between itself and the belt 100.

(C) A coil unit 300 (inductive heating apparatus, or magnetic flux generating means) as a heating device (heating means) for heating the belt 100.

(D) A pair of pressure application mechanisms 710L and 710R (or pressing mechanisms) (FIGS. 3 to 5) disposed at each of the two lengthwise ends of the fixing apparatus F, one for one, to cause the belt 100 and the pressure roller 200 to press against each other to form the nip N in which the toner image t, formed on a sheet S of recording paper, is heated (image heating process, or fixation process).

(E) A pair of pressure changing mechanisms 720L and 720R (FIGS. 3 to 5) that can change in internal pressure in the nip N formed by pressing members of the pressure application mechanisms 710L and 710R, respectively.

(F) A frame 600 (chassis, or housing) that has a bottom plate 601, and a pair of lateral plates 602L and 602R fixed to each of two ends of the bottom plate 601, respectively, and in which such members and mechanisms as the above described ones are held internally (shown in FIGS. 3 to 5 and 7).

(2-1) Belt Unit

As noted, the belt unit 110 has the endless belt 100 having a metallic layer. In addition, the belt unit 110 has an internal assembly having a combination of a fixation pad 103 (also referred to simply as a pad), a padding member 101 that holds the pad 103, a stay 102 that holds the padding member 101, an internal core 104 (internal magnetic core) that covers the stay 102, etc. Part (c) of FIG. 8 is a perspective view of this internal assembly disposed on the inward side of a loop (belt loop) that the belt 100 forms.

Each of the pad 103, the padding member 101, and the stay 102 is a long and narrow component, and is disposed so that its lengthwise direction is parallel to the lengthwise direction of the belt 100 (widthwise direction of fixing apparatus F). The lengthwise end portions of the stay 102 are outwardly protrusive from the belt 100 at the corresponding edges of the belt 100, and are fitted with flanges 105L and 105R, one for one (FIG. 7). The belt 100 is loosely fitted around the components of the internal assembly 101 to 104, and between the mutually opposing surfaces of the flanges 105L and 105R, respectively.

The inward side (opposite side from pad 103) of the padding member 101 is provided with a temperature sensor seat (unshown), positioned at the lengthwise center portion of the padding member 101. The fixing apparatus F is provided with a temperature sensor TH1 (temperature detection element), such as a thermistor, which is attached to the abovementioned temperature sensor seat, with the placement of an elastic supporting member 109 between the temperature sensor TH1 and the corresponding seat.

The elastic supporting member 109 is protrusive outward through a through hole 102*a*, with which the lengthwise center portion of the stay 102, and a through hole 104*a*, with which the portion of the inner core 104 that corresponds in position to the through hole 102*a*, is provided. The temperature sensor TH1 is attached to the tip portion of the elastic supporting member 109, being thereby kept in contact with the inward surface of the lengthwise center portion of the belt 100, by the elasticity of the supporting member 109. Thus, even if the belt 100 waves, the temperature sensor TH1 is enabled to follow the movement of the belt 100 in terms of the direction perpendicular to the rotational direction of the belt 100. Therefore, the temperature sensor TH1 remains satisfactorily in contact with the belt 100.

Part (a) of FIG. 8 is a schematic sectional view of the belt 100, and shows the laminar structure of the belt 100. The belt 100 has a metallic substrative layer 100*a* that is roughly 20 μm to 40 μm in internal diameter. Further, the belt 100 is provided with a heat resistant rubber layer as an elastic layer 100*b* that covers the outward surface of the substrative layer 100*a*. The thickness of the rubber layer 100*b* is desired to be in a range of 100 μm to 800 μm. In this embodiment, in order to reduce the belt 100 in thermal capacity to reduce the fixing apparatus F in the length of time it takes for the fixing apparatus F to warm up, and also, in order to yield a satisfactory fixed image when fixing a color image, the thickness of the rubber layer 100*b* is set to 200 μm. Further, the belt 100 is provided with a fluorinated resin layer (formed of PFA or PTFE) as a release layer 100*c* that covers the outward surface of the elastic layer 100*b*.

In order to reduce the friction between the inward side of the substrative layer 100*a* and the temperature sensor TH1, the inward surface of the substrative layer 100*a* may be covered with a highly slippery layer 100*d* that is roughly 10 μm to 500 μm in thickness. In this embodiment, the inward surface of the substrative layer 100*a* is covered with a 30 μm thick polyimide layer, and the inward surface of the polyimide layer is coated with heat resistant grease to enhance the inward surface of the belt 100 in slipperiness. By the way, the selection of the material for the metallic layer 100*a* of the fixation belt 100 is optional and may be iron alloy, nickel alloy, copper, silver, or the like.

The padding member 101 that holds the pad 103 also causes the belt 100 and the pressure roller 200 to press on each other, forming the nip N between the belt 100 and the pressure roller 200. The pad 103 is formed of a metallic substance, such as stainless steel, ceramics, or the like, which are very hard, and is roughly 1 mm in thickness. The pad 103 is a long and narrow member, and is disposed so that its lengthwise direction is parallel to the lengthwise direction of the fixing apparatus F. The material for the padding member 101 is heat resistant resin such as PPS, LCP, or the like.

The stay 102 for holding the padding member 101 requires rigidity that is necessary to apply pressure to the nip N. Thus, the stay 102 is a rigid member formed of a metallic substance. Regarding the material for the stay 102, it is desired that it is only the belt 100 that is caused to generate heat by the coil unit 300. Thus, the material for the stay 102 is desired to be a nonmagnetic substance, such as stainless steel, that is unlikely to be affected by induction heating.

In order to improve the fixing apparatus F in the level of effectiveness with which the belt 100 is inductively heated, the fixing apparatus F is provided with the inner core 104 that is disposed on the coil unit side of the stay 102. Referring to part (c) of FIG. 8, the inner core 104 is made up of multiple sections that are aligned in the lengthwise direction of the inner core 104 in such a manner that the distance between the coil unit 300, and an excitation coil 301 (described later) gradually changes toward the lengthwise edges (or the center). In order to ensure that the magnetic flux, generated by causing high frequency current to flow through the coil 301, is effectively used to heat the belt 100, the inner core 104 is formed of ferrite, or the like substance, that is high in magnetic permeability, and, therefore, is effective to block magnetic flux.

Regarding the attachment of the belt unit 110 to the apparatus main assembly of the image forming apparatus 1, referring to FIG. 7, each of the lateral plates (walls) 602L and 602R of the frame 600 is provided with a vertical slit (unshown). Thus, the belt unit 110 is held to the frame 600 by fitting the flange portions 105L and 105R into the corresponding vertical slits of the lateral walls, one for one. Thus, the entirety of the belt unit 110 is allowed to vertically move within a preset range, between the lateral plates 602L and 602R. The belt unit 110 is afforded a certain amount of latitude in terms of the vertical movement.

(2-2) Pressure Roller

The pressure roller 200 in this embodiment is an elastic roller that is 30 mm in external diameter. It is made up of a metallic core 200*a*, and an elastic layer 200*b* formed on the peripheral surface of the metallic core 200*a*. The pressure roller 200 is disposed under the belt unit 110, in such an attitude that its axial line is roughly parallel to the lengthwise direction of the belt unit 110. It is rotatably supported between the lateral plates 602L and 602R, with the placement of a pair of bearings 603 between the pressure roller 200 and the lateral plates 602L and 602R, respectively (FIG. 7).

The one of the lengthwise ends of the metallic core 200*a* is coaxially fitted with a pressure roller gear 801 (FIG. 5). To this gear 801, the driving force from a pressure roller motor (driving force source), under the control of a control portion 1000, through a driving force transmitting means. Thus, the pressure roller 200 is rotated, as a rotational driving member, in the counterclockwise direction at a preset control speed (process speed) in the direction indicated by an arrow mark R200 in FIG. 6.

(2-3) Coil Unit

The coil unit 300 is a heating device that inductively heats the belt 100. The coil unit 300 is disposed on the top side of the belt unit 110. The coil unit 300 is made up of a housing 303 that is a long and narrow component disposed so that its lengthwise direction is parallel to the lengthwise direction of the belt 100. It also comprises the excitation coil 301 (a coil that generates magnetic flux), an outer core 302, etc., that are internally attached to the housing 303.

The housing 303 is in the form of a long and narrow rectangular box, and is molded of a heat resistant resin. The housing 303 is disposed so that its bottom plate 303*a* faces the belt 100. The bottom plate 303*a* is sized and shaped so that it covers roughly one half of the outward surface of the belt 100, in terms of the circumferential direction of the belt 100, with the presence of a preset amount of a gap a between itself and the belt 100.

The coil unit 300 is supported by the flanges 105L and 105R, and the end portions of the housing 303 of the coil unit 300 are supported by the flanges 105L and 105R. Thus, the bottom plate 303*a* of the housing 303 faces the upwardly facing portion of the outward surface of the belt 100, with the presence of the preset amount of the gap a. The coil unit 300 is fixed to the belt unit 110, and the lateral plates of the housing 303 of the coil unit 300 are bound to the flanges 105L and 105R, respectively, with the use of wire springs (unshown). That is, the coil unit 300 is integral with the belt unit 110.

Therefore, as the flanges 105L and 105R of the belt unit 110 are moved downward by the pressure applied by the pressing mechanisms 710L and 710R, as will be described later, the coil unit 300 also moves downward with the belt unit 110, while maintaining the gap a. Further, as the pressure applied to the flanges 105L and 105R is reduced or removed, and, therefore, the flanges 105L and 105R move upward, the coil unit 300 also moves upward with the belt unit 110, while maintaining the gap a.

As the electrical wire for the coil 301, Litz wire is used. The Litz wire is wound so that the resultant coil 301 is shaped like the bottom portion of a boat, and conforms in shape to the inward surface of the belt 100. The coil 301 is disposed in the housing 303 in such a manner that it contacts the inward surface of the bottom plate 303*a* that is concave inward of the housing 303. Through the coil 301, a high frequency current, which is 20 kHz to 60 kHz in frequency, is flowed from an electrical power source (excitation circuit) 1008 that is under the control of the controlling portion 1000. Consequently, a magnetic field is generated by the coil 301. Thus, heat is generated in the metallic layer 100*a* (conductive layer) by the current induced by the magnetic field generated by the coil 303.

The outer core 302 is a magnetic core that covers the coil 301 so that the magnetic field generated by the coil 301 does not leak outward of the coil unit 300, and reaches only the metallic layer of the belt 100. Referring to part (b) of FIG. 8, the outer core 302 is a collection of multiple sections aligned in the lengthwise direction. By the way, part (b) of FIG. 8 is a perspective view of the coil unit 300 after the removal of the top cover plate of the housing 303.

(2-4) Fixing Operation

While the image forming apparatus 1 is kept on standby, it keeps the pressure changing mechanisms 710L and 710R in a no pressure mode, in which virtually no pressure is applied to the nip N by the pressing mechanisms 710L and 710R. Further, the pressure roller motor M2 is turned off, and, therefore, the pressure roller 200 is stationary. Further, the power supply to the coil 301 of the coil unit 300 is turned off.

In response to the inputting of a printing job start signal (image formation job start signal), the control portion 1000 begins a pre-rotation operation (preparatory operation for image forming operation) for increasing the temperature of the fixing apparatus F to a preset level.

That is, the control portion 1000 puts the pressing mechanisms 710L and 710R in a preset pressing mode, by controlling the pressure changing mechanisms 720L and 720R with a preset control timing (pressure application state). Thus, the stay 102 of the belt unit 110 is pressed through the flanges 105L and 105R, whereby the internal assembly on the inward side of the belt loop is pressed against the pressure roller 200, with the presence of the belt 100 between the internal assembly and the pressure roller 200, in a manner to press on the elastic layer 200*b* of the pressure roller 200 against the elasticity of the elastic layer 200*b*. Consequently, the pad 103 is pressed against the pressure roller 200 with the presence of the belt 100 between the pad 103 and the pressure roller 200, thereby forming the nip N having a preset width in terms of the recording paper conveyance direction a, between the belt 100 and the pressure roller 200.

Further, the control portion 1000 turns on the pressure roller motor M2. Thus, the driving force from the motor M2 is transmitted to the pressure roller gear 801. Thus, the pressure roller 200 is rotationally driven at a preset speed in the counterclockwise direction indicated by an arrow mark R200 in FIG. 6.

As the pressure roller 200 rotates, rotational force is transmitted from the pressure roller 200 to the belt 100 by the friction between the peripheral surface of the pressure roller 200 and the outward surface of the belt 100, in the nip N. Thus, the belt 100 is rotated by the rotation of the pressure roller 200 around the components of the inner assembly 101 to 104 in the clockwise direction indicated by an arrow mark R100 in FIG. 6, at the same speed as the peripheral velocity of the pressure roller 200, with the inward surface of the belt 100 sliding on the pad 103 (in contact with pad 103). The movement of the belt 100 in the thrust direction, which occurs as the belt 100 is rotated, is regulated by the inwardly facing surfaces of the flanges 105L and 105R, respectively.

Further, the control portion 1000 supplies the excitation coil 301 with a high frequency current (20 kHz to 60 kHz in frequency) from the electrical power source 1008. As the excitation coil 301 is supplied with the high frequency current, it generates an alternating magnetic flux (magnetic field). This magnetic field is guided to the metallic layer 100*a* of the rotating belt 100, by the core 100*c*, on the top side of the belt 100. Thus, an eddy current generates in the metallic layer 100*a*. This eddy current generates heat (Joule's heat) in the metallic layer 100*a*. The metallic layer 100*a* itself generates heat (heat generation by electromagnetic induction). Consequently, the belt 100 increases in temperature.

That is, as a given portion of the rotating belt 100 moves through an area in which the magnetic field generated by the coil unit 300 is present, the metallic layer 100*a* of this portion of the rotating belt 100 is heated by electromagnetic induction. Thus, as the belt 100 is circularly moved, the entirety of the belt 100 is heated, and, therefore, increases in temperature. The temperature of the belt 100 is detected by the temperature sensor TH1. The temperature sensor TH1 detects the temperature of the portion of the belt 100 that corresponds in position to the sheet passage (path), and the information regarding the detected temperature is fed back to the control portion 1000. The control portion 1000 controls the amount by which electrical power is to be supplied to the excitation coil 301 from the electrical power source 1008, so that the detected temperature level (information regarding detected temperature level) inputted from the temperature sensor TH1, remains at the preset target level (fixation temperature, information regarding preset temperature level).

In this embodiment, in order to keep the belt temperature stable at the target level, or 180° C., the high frequency current is changed in frequency, based on the temperature value detected by the temperature sensor TH1 to control the amount by which electrical power is to be inputted into the coil 301. The temperature of the belt 100 is adjusted by changing the high frequency current in frequency.

While the pressure roller 200 is driven as described above, and the belt temperature is kept at the preset level (fixation temperature) after being increased to the preset level, a sheet S of recording paper, bearing an unfixed toner image t, is guided and introduced into the nip N by the guiding member 106, with the toner image bearing surface of the sheet S facing the belt 100. Then, the sheet S is conveyed through the nip N with the belt 100, while remaining sandwiched between the belt 100 and the pressure roller 200, and, therefore, remaining in contact with the outward surface of the belt 100.

Thus, heat is transferred to the sheet S of recording paper and the toner image thereon, primarily from the belt 100. Further, as the sheet S is conveyed through the nip N, the unfixed toner image t is also subjected to the internal pressure of the nip N. Thus, the unfixed toner image t is fixed to the surface of the sheet S (thermal fixation). After being conveyed through the nip N, the sheet S is separated from the outward surface of the belt 100 by the deformation of the belt 100 that occurs at the exit portion of the nip N. The sheet S is separated from the outward surface of the belt 100 by the curvature of the pressure roller 200, while being assisted by the separation guide 107. Then, the sheet S is guided out of the fixing apparatus F by a guiding member 108.

In order to prevent a sheet S of recording paper from wrapping around the belt 100 after it comes out of the exit portion of the nip N, and also, to prevent the separation guide 107 from damaging the belt 100 by coming in contact with the belt 100, the separation guide 107 is disposed so that a certain amount of distance (a gap) remains between the separation guide 107 and the belt 100. The separation guide 107 is in engagement with a part of the flange 105L and a part of the flange 105R, and these components are fixed with the use of a pressure generating means, such as springs.

As a printing job is completed, the control portion 1000 puts the image forming apparatus 1 through a preset post-rotation process, and then, puts the image forming apparatus 1 on standby. As for the fixing apparatus F, the pressing mechanisms 710L and 710R are put back in the no pressure mode. Then, the pressure roller motor M2 is turned off, along with the power supply to the coil 301 of the coil unit 300.

(2-5) Pressing Mechanism and Pressure Changing Mechanism

The pressing mechanisms 710L and 710R in this embodiment are such mechanisms that are for pressing the flanges 105L and 105R (pressing members) of the belt unit 110 to form the nip N having a preset width in terms of the recording paper conveyance direction, between the belt 100 and the pressure roller 200. The pressure changing mechanisms 720L and 720R (pressure removing mechanisms) are such mechanisms that are for changing the pressing mechanisms 710L and 710R in the amount of pressure.

In this embodiment, the fixing apparatus F is provided with a pair of pressing mechanisms 710L and 710R and a pair of pressure changing mechanisms 720L and 720R that are symmetrically disposed on the outward side of the pair of lateral plates 602L and 602R of the apparatus frame 600, respectively. The two pairs of mechanisms are configured so that they synchronously operate. Thus, the two pair of mechanisms 710 and 720 are described with reference to primarily the pressing mechanism 710L and the pressure changing mechanism 720L at each of one of the lengthwise ends of the fixing apparatus F.

(a) Pressing Mechanism

The pressing mechanisms 710L and 710R are each made up of a pressure bearing plate 700 (pressure bearing member), a pressure plate 701 (pressing member), a pressure plate 702 (pressing member), an axle 703, a compression spring 704, a compression spring 705, and a pressure adjustment screw 709.

The pressure bearing plate 700 of the pressing mechanism 710L disposed at one of the lengthwise ends of the fixing apparatus F, and pressure bearing plate 700 of the pressing mechanism 710R are disposed at the other lengthwise end of the fixing apparatus F, are supported by a pressure removal shaft 708 that is put through the left and right lateral plates and 710R and 710L of the apparatus frame 600, respectively. The pressure bearing plates 700 are fixed to the left and right lateral plates 710R and 710L by the tip of the corresponding pressure bearing plate 700, respectively, with the use of small screws 403.

The pressure plate 701 and the pressure plate 702 are supported by an axle 703, being thereby allowed to rotationally move relative to the pressure bearing plate 700. The pressure plate 701 and the pressure plate 702 are under the pressure generated by the compression springs 705 in the direction to press the flanges 105L (or 105R) toward the pressure roller 200. The pressure plate 701 presses the flange 105L (or 105R) through the pressure plate 702.

The pressure bearing plate 700 is provided with the pressure adjustment screw 709 that is attached to the pressure bearing plate 700 by being threaded through the plate 700, so that the compression spring 704 can be adjusted in length by the tightening or loosening of the pressure adjustment screw 709 to adjust the amount of the load applied to the flange 105L (or 105R) by the spring.

FIG. 9 is a sectional view of the pressing mechanism 710 (710L or 710R) at a plane indicated by an arrow mark A-A in FIG. 4. FIG. 10 is a sectional view of the pressing mechanism 710 at a plane indicated by an arrow mark B-B in FIG. 4. The pressure plate 702 is provided with a protrusive portion 702*a* that protrudes from a part of the flange pressing surface of the pressure plate 702. The pressing mechanism 710 is structured so that, as this protrusive portion 702*a* is pressed by the pressure plate 701, the flange 105L (or 105R) is simultaneously pressed by both the pressure plate 701 and pressure plate 702, and the nip N is formed between the pressure roller 200 and the belt 100.

The pressing mechanism 710 is configured so that the compression spring 704 is greater in resiliency than the compression spring 705. For example, when the amount of pressure to be applied to the nip N is 550N, 520N is to be exerted by the compression spring 704, whereas the remaining 30N is to be exerted by the compression spring 705. A nip pressure of 550N is used for such recording medium as ordinary paper, glossy paper, cardstock, or the like. Hereafter, this nip pressure is referred to as the normal nip pressure (or simply as normal pressure). By controlling the nip pressure applied in the normal pressure mode, a recording paper conveyance speed, and a target level for temperature control, it is possible to satisfactorily fix a toner image tin terms of state of fixation and glossiness, not only on ordinary recording paper, but also, on cardstock and glossy paper.

(b) Pressure Changing Mechanism

The pressure changing mechanism 720L (or 720R) (pressure switching mechanism) is made up of a pressure removal cam 706, a pressure removal gear 707, and a pressure removal shaft 708.

The pressure removal cam 706, as a part of a pressure removing mechanism, is disposed on the opposite side of the flange 105L from the axle 703. The pressure removal gear 707 and the pressure removal shaft 708 are disposed on the outward side of the space in which the pressure plates of the pressure bearing plates 700 are held. By the way, the pressure changing mechanism 720R is not provided with the pressure removal gear 707. The pressure removal gear 707 and the pressure removal cam 706 are coaxially disposed, and are in engagement with each other so that the pressure removal cam 706 is rotated by the rotation of the pressure removal gear 707.

The pressure removing mechanisms are provided with a pair of pressure removal cams 706 that are attached to the lengthwise ends of the pressure removal shaft 708, one for one, in such a manner that they are parallel to each other, and align with each other in the lengthwise direction of the pressure removal shaft 708. In terms of profile, the pressure removal cams 706 have a small diameter portion 706*b* and a large diameter portion 706*a*. Thus, as each pressure removal cam 706 is rotated, the pressure plate 701 is pivotally moved about its pivot by the large diameter portion 706*a* of the pressure removal cam 706.

FIG. 11 shows the amount by which the pressure plates 701 and 702 are made to pivot about their pivots by the small diameter portion 706*b* and the large diameter portion 706*a* when the pressure removal cam 706 is rotated. The vertical axis corresponds to 0° in cam angle. Referring to FIGS. 5, 9 and 10, the counterclockwise direction in which the pressure plates 701 and 702 are pivotally moved about the shaft 708 is referred to as the positive direction.

(b-1) Low Pressure Mode

Next, referring to FIG. 2, the operation to be carried out by the image forming apparatus 1 when the fixing apparatus F is kept in a state in which the nip pressure is low (which hereafter will be referred to as a "low pressure mode") is described. As a printing job (JOB) that requires the image forming apparatus 1 (and the fixing apparatus F) to be operated in the low pressure mode, for example, a printing job for printing on envelopes (recording medium is an envelop), is inputted, the control portion 1000 puts the fixing apparatus F in the low pressure mode.

The driving force of the pressure control motor M1 (FIG. 5) that is under the control of the control portion 1000 is transmitted to the pressure removal gear 707 by way of the driving force transmitting means, whereby the pressure removal gear 707 is rotated in the clockwise direction. Thus, the pressure removal shaft 708 and the pressure removal cam 706, which are in engagement with the pressure removal gear 707 through a parallel pin and a D-cut portion, are rotated by the rotation of the pressure removal gear 707. FIG. 12 shows the state of the fixing apparatus F in which the pressure removal cam 706 is stationary at an angle that corresponds to the low pressure mode, that is, the state in which the fixing apparatus F is in the low pressure mode. The pressure changing mechanism 720R, or the pressure changing mechanism at the other lengthwise end of the fixing apparatus F, is also rotated by the pressure removal shaft 708, being therefore the same in operation as the pressure changing mechanism 720L.

In FIG. 12, the pressure plate 701 is in a position into which it was pushed up by the large diameter portion 706*a* of the pressure removal cam 706. Thus, the belt unit 110 is under no pressure. Further, the small diameter portion 706*b* is not in contact with the pressure plate 702, and, therefore, the pressure plates 701 and 702 are not in contact with each other. Therefore, the pressure from the pressure plate 702 can be easily borne by the pressure removal cam 706. Thus, the pressure from the compression spring 704 does not act on the flange 105L.

The pressure plate 702 is provided with the compression spring 705. Thus, when the fixing apparatus F is in the state shown in FIG. 12, only the compression spring 705 acts on the flange 105L (or 105R). As was stated in the description of the normal pressure mode, the force generated by the compression spring 705 is roughly ⅛ of that by the compression spring 704. That is, the nip pressure in the low pressure mode is substantially smaller than that in the normal pressure mode.

(b-2) No Pressure Mode

When the image forming apparatus 1 is not in operation, the power source switch is OFF, and/or the image forming apparatus 1 is jammed with recording medium, the control portion 1000 puts the fixing apparatus F in the no pressure mode. That is, the fixing apparatus F is changed in operational mode from the normal pressure mode or the low pressure mode into the no pressure mode shown in FIG. 13.

The no pressure mode is different from the low pressure mode in that both the pressure plate 701 and the pressure plate 702 are lifted by the large diameter portion 706*a* and the small diameter portion 706*b*, respectively. Thus, the pressure removal cam 706 catches both the pressure from the compression spring 704 and that from the compression spring 705. Therefore, there is no pressure in the nip N (between the belt 100 and the pressure roller 200, or a no pressure mode). Therefore, not only are the belt 100 and the pressure roller 200 prevented from being semi-permanently deformed, but also, it is easier for an operator to remove a jammed sheet S of recording medium from the fixing apparatus F.

(2-6) Control Sequence

Next, referring to FIG. 14, which shows a block diagram of the image forming apparatus 1 in this embodiment, the control sequence in this embodiment is described. The control portion 1000 (printer controlling portion) is provided with a CPU 1001 (central processing unit), a memory 1002, etc. The control portion 1000 integrally controls the entire mechanical portions of the image forming apparatus 1. A referential code 2000 stands for a control panel with which the image forming apparatus 1 is provided. A referential code 3000 stands for an external host apparatus, such as a personal computer (PC), or the like, that is in electrical connection to the control portion 1000 by way of an interface.

The information (size, basis weight, type) regarding the recording paper (recording medium) that is going to be used by a user is sent from the control panel 2000 or from a host apparatus 3000 to the recording medium information processing portion 1003, from which the information is transferred to the CPU 1001.

The CPU 1001 refers to the memory 1002, and commands the pressure controlling portion 1006 to set the pressure of the nip N of the fixing apparatus F to a preset value, based on the information from the recording medium information processing portion 1003. The pressure controlling portion 1006 sets the pressure of the nip N of the fixing apparatus F to the preset value. That is, the CPU 1001 controls the pressure control motor M1, by way of the pressure controlling portion 1006, so that the pressure of the nip N of the fixing apparatus F is set to the preset value.

The CPU 1001 can set the target level for the temperature control of the belt 100 by controlling the electrical power source apparatus 1008, based on a combination of the information from a temperature-humidity sensor 1004 attached to the main assembly of the image forming apparatus 1, and the temperature detected by the temperature sensor TH1 for the belt 100. Further, the CPU 1001 can change fixing apparatus F in the target temperature (for belt temperature control) for the belt 100, by controlling the target temperature changing portion 1007.

Further, the CPU 1001 can make the pressure roller 200 rotate or stop, by controlling the pressure roller motor M2. Moreover, the CPU 1001 can change the speed with which a sheet of recording paper is conveyed by the driving of the pressure roller 200, by controlling a conveyance speed switching portion 1005.

The control panel 2000, as a selecting portion, is a part of the main assembly of the image forming apparatus 1. The control panel 2000 is provided with multiple keys for a user to select one of preset commands. FIG. 15 is a schematic drawing of an example of the control panel 2000. This control panel 2000 is provided with several hard keys (that are to be pressed by operator), such as a start button 501 (for commanding image forming apparatus 1 to start image formation), numerical value input keys 502 (0 to 9), and a subordinate power source switch 504. The control panel 2000 is also provided with a liquid crystal display 503 as a touch panel.

This touch panel 503 displays command buttons related to image formation. For example, the touch panel 503 displays such soft keys (portions to be touched by operator) as a recording paper (recording medium) selection button (for selecting a basis weight of recording paper (medium)), a button for selecting two-sided mode, a button for stapling, etc. These buttons are to be touched by an operator to give the image forming apparatus 1 various commands.

The screen 503 (image) displayed on the touch panel 503, which is a liquid crystal display portion of the control panel 2000, and the screen 503 (image) displayed on the display of the user's PC, which is the external host apparatus, are the same. Therefore, both are given the same numerical code 503.

When a user wants to print or to copy an image, the user is to select a recording paper type from among the various choices given on the display. The information selected by a user with the use of the control panel 2000 is sent to the CPU 1001 by way of the recording medium information processing portion 1003.

Referring to FIG. 17, which is a flowchart of the control sequence for the image forming apparatus 1 in this embodiment, the control sequence in this embodiment is described. As the image forming apparatus 1 receives an image formation job (S1), the CPU 1001 determines whether or not a user chose an envelope B101 from the screen 503 (FIG. 16) (S2). If the CPU 1001 determines that the recording medium to be conveyed through the image forming apparatus 1 (fixing apparatus F) is not an envelope, the CPU 1001 puts the fixing apparatus F in the normal pressure mode (S4'), and then, makes the image forming apparatus 1 carry out the image forming operation and fixing operation (S5).

When the recording medium to be conveyed is an envelope, the CPU 1001 determines whether or not the job requires the fixing apparatus F to be set in the low pressure mode (S3). If the envelope width is no more than 140 mm, the CPU 1001 puts the fixing apparatus F in the low pressure mode (S4), and then, makes the image forming apparatus 1 carry out an image forming operation and a fixing operation (S5).

When the recording medium to be conveyed is an envelope, and wider than 140 mm, the CPU 1001 puts the fixing apparatus F in the normal pressure mode (S4'), and then, makes the image forming apparatus 1 carry out an image forming operation and a fixing operation (S5).

In the low pressure mode, the nip pressure is low, and the lengthwise end portions of the fixing apparatus F are rather narrow in nip width, being therefore low in fixing performance. Therefore, when the recording medium is a wider envelope, the CPU 1001 keeps the fixing apparatus F in the normal pressure mode.

Next, referring to FIG. 18, which is a flowchart, the fixing operation carried out in each mode is described. To begin with, the nip pressure of the fixing apparatus F is adjusted to the normal one (S1100). Then, the CPU 1001 rotates the pressure roller 200 and the belt 100, by driving the pressure roller 200, and applies voltage to the coil 301 to heat the belt 100 (S1101). The CPU 1001 continues the heating and rotation of the pressure roller 200 and the belt 100 until the belt temperature reaches the preset temperature control level (S1102).

If the mode selected for the fixing apparatus F during the control sequence shown in FIG. 17 is the low pressure mode, the CPU 1001 puts the fixing apparatus F in the low pressure mode (S1103, S1104). An unfixed toner image t on a sheet S of recording paper is fixed to the sheet S by introducing the sheet S into the nip N and conveying the sheet S through the nip N (S1105). The steps S1103 to S1105 are repeated until the on-going printing job is completed (S1106). As soon as the job is completed, the CPU 1001 stops the rotation of the fixation motor and the electrical power supply to the coil 301 (S1107). Then, the CPU 1001 changes the nip pressure of the fixing apparatus F to the normal one, or zero (S1108).

(2-8) Envelope Crease Prevention Mode

Even if envelops are the same in size, they can be different in basis weight, rigidity, surface properties, etc. Generally speaking, the greater an envelope is in basis weight, the more rigid the envelope is, and, therefore, less likely to be creased. The greater an envelope is in basis weight, however, the greater the amount of heat necessary to properly fix toner to the sheet of which the envelope (recording medium) is made. On the other hand, the smaller an envelope is in basis weight, the less the envelope is in rigidity, and, therefore, more likely to be creased by the fixation process. The smaller an envelope is in basis weight, however, the smaller the amount of heat necessary to properly fix toner to the sheet, of which an envelope (recording medium) is made.

The envelope crease prevention mode is such a mode that, in order to yield a high quality fixed image while preventing the envelope from creasing, the fixation conditions, more specifically, (a) a target temperature level (fixation temperature) for temperature control, (b) a nip pressure (fixation pressure), and (c) a process speed (fixation speed) are switched.

(a) Method for Putting Fixing Apparatus in Envelope Crease Prevention Mode

As an operator selects "envelope B101" from the screen on the display 503 shown in FIG. 16, the screen changes to the screen A, shown in FIG. 19, for adjusting the fixing apparatus F in crease prevention value, or the crease prevention level. In this embodiment, the screen 503A is such a screen that can be used by a user to adjust, in steps, the fixing apparatus F in the aforementioned nip pressure, target temperature level, and recording medium conveyance speed.

In this embodiment, eight crease prevention settings are provided (−2 to +5). As a user selects one of the eight crease prevention settings, the aforementioned three parameters are automatically changed in steps. That is, as a user selects one of the crease prevention levels, the control portion 1000 automatically controls the fixing apparatus F in fixation condition, freeing the user from bothersome task of manually setting the aforementioned fixation conditions. By the way, the default setting for the crease prevention is zero. The greater the crease prevention value, the less likely for an envelope to be creased.

That is, as a user selects one of the values on the screen 503A for the crease prevention setting, the fixing apparatus F is automatically changed in the nip pressure, target temperature level, and recording medium conveyance speed. Then, the control portion 1000 (executing portion) adjusts the pressure changing mechanism 720, the target temperature changing portion 1007, and the conveyance speed switching portion 1005 to put the fixing apparatus F in the crease prevention mode set by the user with the use of the screen 503A. Then, it makes the fixing apparatus F to heat the toner image t on a sheet S of recording paper (recording medium).

(b) Details of Envelope Crease Prevention Mode

1. Nip pressure: the lower, the better for envelope crease prevention; high sensitivity.

2. Process speed (conveyance speed): the higher, the better for envelope crease prevention, medium sensitivity.

3. Temperature control target level: the lower, the better for envelope crease prevention; low sensitivity.

As the fixing apparatus F is increased in the crease prevention setting value, it is made more unlikely, by a combination of the aforementioned three parameters, for an envelope to be creased by the fixation process. The fixing apparatus F reduces, however, in fixation performance. As described above, an envelope that is likely to be creased by fixation is small in basis weight, being, therefore, advantageous from the standpoint of fixation. Thus, when an envelope that is small in basis weight is used as the recording medium, it is easier to output a high quality image.

Further, the parameters, which are changed in value when the numerical setting in the crease prevention mode is changed in value according to the width of an envelope, are different from those according to the width of another envelope that is different from the first one. That is, the fixing apparatus F is changed in the threshold values for the nip pressure, the temperature control target level, and its characteristics.

Envelope A (width: 100≤x<140)

Default setting (crease prevention setting: 0)

1. Nip pressure: low pressure

2. Process speed: half speed

3. Temperature adjustment: ±0° C.

First, as the crease prevention value is set to +1 and +2, the temperature adjustment value reduces to −10° C. and −20° C., respectively. That is, as the fixing apparatus F is adjusted in target temperature that is low in sensitivity, the fixation condition gradually becomes beneficial for crease prevention. Then, as the crease prevention setting becomes +3, the target temperature level reverts to the default, and the process speed becomes normal.

If it is desired to improve the fixing apparatus F in image quality when an envelope that is high in rigidity, and, therefore, is unlikely to be creased, is used as recording medium, it is recommended to lower the fixing apparatus F in the crease prevention value. For example, as the crease preventing value is set to −2, the nip pressure becomes normal. Thus, it is possible to obtain an image that is free of the defects attributable to the creasing of the envelope, and is high in glossiness level.

Envelope B (width: 140≤x<162)

Default setting (crease prevention setting: 0)

1. Nip pressure: normal pressure

2. Process speed: normal speed

3. Temperature adjustment: ±0° C.

First, as the crease prevention value is set to +1, the nip pressure is switched to the envelope pressure, the process speed is reduced to half, and the temperature adjustment setting changes to +10° C. That is, instead of changing the nip pressure, which is higher in sensitivity, to the one that is advantageous from the standpoint of crease prevention, the

TABLE 1

| | Width | Items | −2 | −1 | ±0 | +1 | +2 | +3 | +4 |
|---|---|---|---|---|---|---|---|---|---|
| ENVLP A | 100 ≤ X < 140 | Nip P. | Nor. | | | Low P. | | | |
| | | P. Speed | Same | | Half | | | Same | |
| | | CORRECTION | ±0° C. | +10° C. | ±0° C. | −10° C. | −20° C. | ±0° C. | −10° C. |
| ENVLP B | 140 ≤ X < 162 | Nip P. | | Nor. | | | Low P. | | |
| | | P. Speed | | Same | | | Half | | Same |
| | | CORRECTION | +20° C. | +10° C. | ±0° C. | −10° C. | ±0° C. | −10° C. | ±0° C. |
| ENVLP C | 162 ≤ X < 240 | Nip P. | | Nor. | | | Low P. | | |
| | | P. Speed | | Same | | | | Half | |
| | | CORRECTION | +20° C. | +10° C. | ±0° C. | −10° C. | ±0° C. | −10° C. | ±0° C. |
| ENVLP D | 240 < X | Nip P. | | | | Nor. | | | |
| | | P. Speed | | | | Same | | | |
| | | CORRECTION | +20° C. | +10° C. | ±0° C. | | −10° C. | | |

other parameters are set to be disadvantageous from the standpoint of crease prevention (advantageous from standpoint of fixation), to finely adjust the fixing apparatus F. As the crease prevention setting is set to +2 and +3, the temperature adjustment target value reduces. Then, as the crease prevention setting becomes +4, the target temperature level reverts to the default, and the process speed becomes normal.

If it is desired to improve the fixing apparatus F in image quality, it is recommended to lower the fixing apparatus F in the crease prevention value to −1 or −2, so that the fixing apparatus F becomes higher in temperature target level.

Envelope C (width: 162≤x<240)

Default setting (crease prevention setting: 0)

1. Nip pressure: normal pressure
2. Process speed: normal speed
3. Temperature adjustment: ±0° C.

As the crease prevention value is set to +1, the temperature adjustment value changes to −10° C. As the crease prevention value is set to +2, the nip pressure is switched to the envelope pressure, the process speed is halved, and the temperature adjustment value is switched to +10° C. Further, as the crease prevention value is set to +3 and +4, the temperature adjustment value reduces accordingly.

If it is wanted to raise the fixing apparatus F in image quality, the crease prevention value is to be set to −1 or −2 so that the fixing apparatus F is increased in fixation temperature.

Envelope D (width: 240<x)

Default setting (crease prevention setting: 0)

1. Nip pressure: normal pressure
2. Process speed: normal speed
3. Temperature adjustment: ±0° C.

When the envelope width is greater than 240 mm, the low pressure mode is unsatisfactory in terms of recording medium conveyance force, and, therefore, it is possible that the pressure roller 200 and/or the belt 100 will slip on the envelope. Thus, in a case in which the recording medium is an envelope of this size, the nip pressure is not changed even if the fixing apparatus F is reduced in the crease prevention value.

Figure 1:
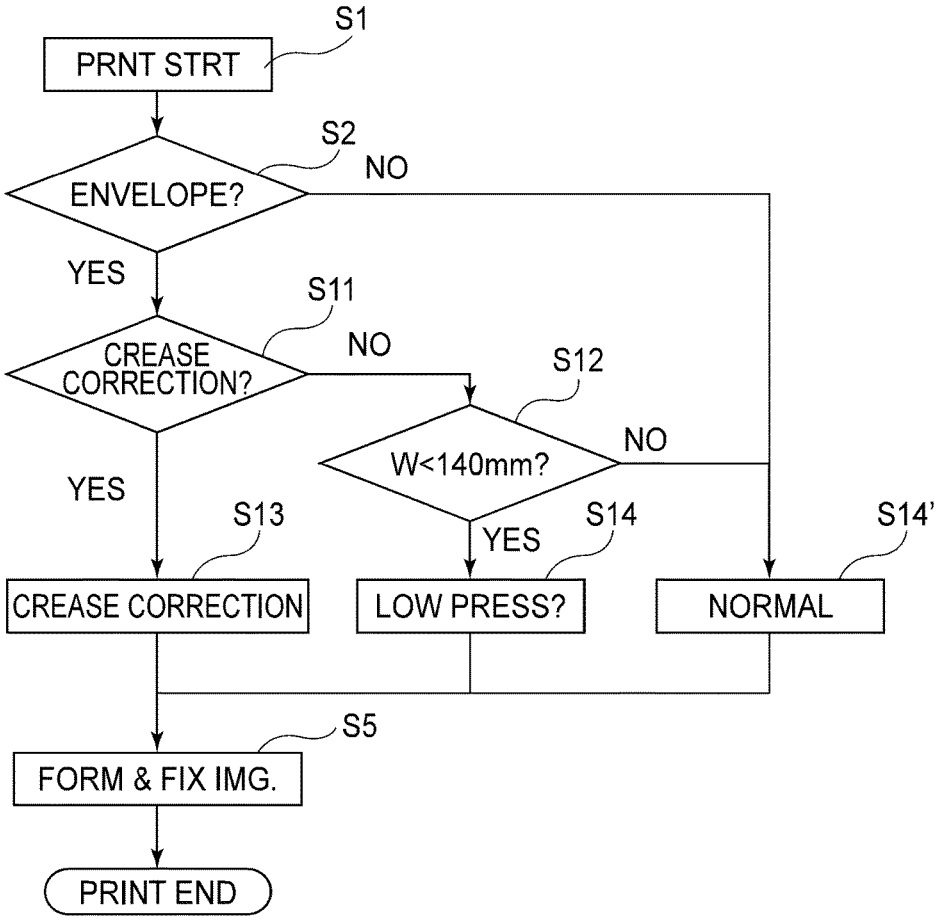
FIG. 1 is a flowchart of the control sequence, in the first embodiment of the present invention, when the image forming apparatus is in the crease prevention mode.

(C) Control Sequence for Putting Fixing Apparatus F in Crease Prevention Mode for Envelop Next, referring to FIG. 1 which is a flowchart, the control sequence for putting the fixing apparatus F in the crease prevention mode is described. First, the image forming apparatus 1 receives an image formation job (S1). Then, the CPU 1001 determines whether or not the received job is the envelop job that matches the "envelop B101" selected by a user from the display screen 503 (FIG. 16) (S2). If the recording medium to be conveyed is not an envelope, the CPU 1001 sets the nip pressure to the normal one (S14'), and makes the image forming apparatus 1 carry out an image forming operation and a fixing operation (S5).

If the CPU 1001 determines that the recording medium to be conveyed is an envelope, it determines whether or not the image forming apparatus 1 (fixing apparatus F) is in the envelop crease prevention mode (S11). If the CPU 1001 determines that the image forming apparatus 1 (fixing apparatus F) is not in the envelop crease prevention mode, it determines whether or not the received job is such a job that recording medium is to be conveyed under the envelop pressure (S12). If the envelope width is no more than 140 mm, the CPU 1001 sets nip pressure to the envelope pressure (S14), and makes the image forming apparatus 1 carry out an image forming operation and a fixing operation (S5). If the envelope width is no less than 140 mm, the CPU 1001 sets the nip pressure to the normal one (S14'), and makes the image forming apparatus 1 carry out an image forming operation and a fixing operation (S5).

If the fixing apparatus F is in the crease prevention mode for an envelope, the CPU 1001 changes the fixing apparatus F in fixation temperature and nip pressure, and the image forming apparatus 1 in process speed, according to Table 1 (S13). Then, it makes the image forming apparatus 1 carry out an image forming operation and a fixing operation (S5).

The present invention described above makes it possible to provide a fixing apparatus that is capable of delivering high quality images while preventing a recording medium from being creased by fixation, regardless of envelope size and properties. The embodiment described above is only one of the preferred embodiments of the present invention, and is not intended to limit the present invention in scope in terms of the settings of an image forming apparatus and its fixing apparatus.

<Miscellanies>

(1) In the preceding embodiment of the present invention, the fixing apparatus F was an image heating apparatus for fixing an unfixed toner image t formed on a sheet S of recording paper (recording medium) to the sheet S, by heating the toner image t. The embodiment is not intended to limit the present invention in scope in terms of the type of image heating apparatus to which the present invention is applicable. For example, the present invention is also applicable to an apparatus (glossing apparatus) for increasing an amount of gloss of a toner image t that was permanently or temporarily fixed to a sheet S of recording paper, by reheating the toner image t.

(2) The present invention is also applicable to an image heating apparatus in which each of the rotational heating member and the rotational pressing member is a roller or an endless belt. Further, the present invention is also applicable to an image heating apparatus in which one of the rotational heating member and the rotational pressing member is a roller, and the other is an endless belt.

(3) The present invention is applicable to any image heating apparatus, as long as its pressing mechanism is structured so that at least one of the rotational member and the rotational pressing member is pressed upon the other.

(4) The application of the present invention is not limited to an image heating apparatus, such as the one in the preceding embodiment, that employs an inductive heating device. That is, the present invention is also applicable to any image heating apparatus structured so that at least one of the rotational heating member and the rotational pressing member is externally or internally heated by a heating device of the so-called contact type, or radiant heating device.

(5) The application of the present invention is not limited to such an image forming apparatus as the image forming apparatus in the preceding embodiment that form a full-color image. That is, the present invention is also applicable to an image forming apparatus that forms a monochromatic (black-and-white) image. Further, the present invention is also applicable to a multifunction image forming apparatus that is provided with additional devices, equipment, shells, etc., and that is capable of functioning as a copying machine, a facsimile machine, etc.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming station configured to form a toner image on a recording material;

a fixing portion configured to fix the toner image formed by said image forming station on the recording material;

a selector configured to select a correction level for correcting a crease of an envelope, by an operator; and a controller configured to control a fixing condition in response to the correction level selected on said selector.

2. An apparatus according to claim 1, wherein the fixing condition includes a fixing temperature, a fixing speed, and a fixing pressure force.

3. An apparatus according to claim 2, wherein said controller controls the fixing condition in response to the correction level and a width of the envelope.

4. An apparatus according to claim 3, wherein thresholds for switching the fixing temperature, the fixing speed, and the fixing pressure force are different depending on the width of the envelope.

5. An apparatus according to claim 1, wherein said controller controls the fixing condition in response to the correction level and a width of the envelope.

6. An apparatus according to claim 1, wherein the correction level is selectable from a plurality of predetermined choices.

7. An apparatus according to claim 6, wherein said selector includes a display portion configured to prompt the operator to select the correction level.

* * * * *